US011287210B1

(12) United States Patent
Booher et al.

(10) Patent No.: US 11,287,210 B1
(45) Date of Patent: Mar. 29, 2022

(54) TOY LAUNCHER APPARATUS USING INTEGRAL COMPONENTRY WITH QUICK ASSEMBLY METHODS

(71) Applicant: Hasbro, Inc., Pawtucket, RI (US)

(72) Inventors: Timothy Booher, Franklin, KY (US); Robert James Victor, New York, NY (US)

(73) Assignee: Hasbro, Inc.

( * ) Notice: Subject to any disclaimer, the term of this patent is extended or adjusted under 35 U.S.C. 154(b) by 89 days.

(21) Appl. No.: 16/930,068

(22) Filed: Jul. 15, 2020

Related U.S. Application Data

(60) Provisional application No. 62/875,651, filed on Jul. 18, 2019.

(51) Int. Cl.
*F41B 7/08* (2006.01)
*A63F 9/02* (2006.01)
*A63H 33/18* (2006.01)

(52) U.S. Cl.
CPC ..... *F41B 7/08* (2013.01); *A63F 9/0252* (2013.01); *A63H 33/18* (2013.01); *A63F 2009/0265* (2013.01)

(58) Field of Classification Search
CPC ..... F41B 7/00; F41B 7/003; F41B 7/08
See application file for complete search history.

(56) References Cited

U.S. PATENT DOCUMENTS 1,353,663 A 9/1920 Napier
1,374,757 A 4/1921 Napier
1,376,544 A * 5/1921 Hood ..... F41B 7/003 124/27
1,441,975 A 1/1923 Edelin
1,488,995 A 4/1924 McCollom
2,401,485 A * 6/1946 Jarnagin ..... F41B 7/08 124/7
2,476,212 A * 7/1949 Nitz ..... F41B 7/003 124/27
2,636,738 A * 4/1953 Abagoff ..... F41B 7/003 473/511
2,737,942 A 3/1956 Horowitz et al.
3,054,536 A 9/1962 Sagarin
3,420,133 A 1/1969 Proll
3,990,426 A 11/1976 Stokes
4,016,854 A 4/1977 Lehman
4,170,215 A 10/1979 Kettlestrings
4,248,202 A 2/1981 Jaworski et al.
4,659,320 A 4/1987 Rich et al.
(Continued)

*Primary Examiner* — John A Ricci
(74) *Attorney, Agent, or Firm* — Perry Hoffman

(57) ABSTRACT

An inexpensive toy projectile launch apparatus incorporating pivotally connected housings which may be quickly and easily assembled. The hand held toy projectile launchers include a flexible plastic launch spring having engaging portions mounted within the housings to enable an operator to move the housings in relation to one another using one hand, with an end portion of the launch spring for engaging and launching a projectile. Each component includes a number of structures such that assembly is simple, but the structure is both robust and inexpensive. The apparatus may launch soft foam darts or soft foam spheres and each launch apparatus includes an elongated strip-like plastic launch spring that bends when primed so as to provide energy for launch.

20 Claims, 27 Drawing Sheets

(56) References Cited

U.S. PATENT DOCUMENTS

| | | | | |
|---|---|---|---|---|
| 4,841,945 | A | 6/1989 | Braden | |
| 4,890,404 | A | 1/1990 | Ferri | |
| 5,156,137 | A | 10/1992 | Clayton | |
| 5,471,967 | A | 12/1995 | Matsuzaki et al. | |
| 5,529,050 | A | 6/1996 | D'Andrade | |
| 5,613,482 | A * | 3/1997 | Thai | F41B 7/003 124/16 |
| 6,488,019 | B2 | 12/2002 | Kotsiopoulos | |
| 7,051,727 | B2 | 5/2006 | Wu | |
| 7,481,209 | B1 | 1/2009 | Bligh et al. | |
| 8,082,909 | B2 | 12/2011 | Sopinsky et al. | |
| 8,127,753 | B1 | 3/2012 | Brooks et al. | |
| 8,397,705 | B2 | 3/2013 | DeHaan et al. | |
| 8,567,378 | B2 | 10/2013 | Nugent | |
| 8,695,579 | B2 | 4/2014 | Huebl | |
| 8,875,688 | B2 | 11/2014 | Nugent | |
| 9,389,042 | B1 | 7/2016 | Clayton | |
| 9,958,230 | B1 | 5/2018 | Nugent et al. | |
| 2002/0166551 | A1 | 11/2002 | Lee | |
| 2009/0095272 | A1 | 4/2009 | Zimmerman | |
| 2010/0206281 | A1 | 8/2010 | Kanitz et al. | |
| 2013/0112184 | A1 | 5/2013 | Corsiglia et al. | |
| 2013/0312722 | A1 | 11/2013 | Price | |

* cited by examiner

TOY LAUNCHER APPARATUS USING INTEGRAL COMPONENTRY WITH QUICK ASSEMBLY METHODS

FIELD OF THE INVENTION

The present invention relates generally to toy launcher apparatus and, more particularly, to toy projectile launchers having few inexpensive components formed of plastic and an assembly process that is quick and easy.

BACKGROUND OF THE INVENTION

Toys and other devices that discharge projectiles have been designed in the past with various housing and internal elements. These devices are often difficult to use or even dangerous for children, or are too expensive, complicated or insufficiently robust.

Launching devices, toy and otherwise, are well known and are disclosed in several existing patents. By way of example, U.S. Pat. No. 5,156,137 to Clayton for "Projectile launcher" issued Oct. 20, 1992 concerns a projectile launching device where a spring, housed inside the barrel, rests against the release member of the lever assembly such that when a projectile is inserted into the barrel it compresses the spring against the release member and pivots the lever assembly to force the hook into the barrel and into engagement with the projectile tab as being locked together. U.S. Pat. No. 8,875,688 to Nugent for "Safety valve for toy air guns" issued Nov. 4, 2014, and U.S. Pat. No. 5,529,050 to D'Andrade for "Safety nozzle for projectile shooting air gun" issued Jun. 25, 1996 the disclosures of which are incorporated herein by reference, including figures and description of other safety features. U.S. Pat. No. 4,016,854, for a "Spring Type Bottle Cap Pistol" issued in 1977 to Lehman that purports to disclose a pistol to propel and spin a bottle cap by attaching a compression spring to a plunger in a lower chamber, attaching a hammer to the plunger, where the hammer extends through a slot in a upper chamber where the bottle cap is loaded. The plunger is pulled back by a user to compress the spring and the plunger is restrained by a trigger assembly. Napier patented a launching device in 1920 and again in 1921, U.S. Pat. No. 1,353,663 for a "Target Throwing Device" and U.S. Pat. No. 1,374,757 for a "Catapult." These patents purport to disclose a launching device for clay pigeon targets and include a slanted platform with a guide way in the platform.

U.S. Pat. No. 4,659,320 for a "Toy Vehicle with Disc Launching Apparatus and Disks" issued in 1987 to Rich et al, and purports to disclose a toy vehicle carrying an inclined track for storing multiple disks and a spring biased catapult lever. Another U.S. Pat. No. 4,248,202 for a "Disc Launcher" issued in 1981 to Jaworski and Breslow, purports to disclose a mechanical launcher having a circular casing, a disc magazine for feeding discs by gravity, an actuating arm movable between a loading position and a firing position, a spring and a rubber band biased trigger. In the loading position the actuating arm receives a soft round disc in front of a curved edge portion. A user rotates the actuating arm and the edge portion to a firing position, the actuating arm preventing any more discs falling from the magazine, while moving a free arm of the spring loads the spring. All the while a launching slot is blocked. The user then returns the actuating arm to the loading position. When the user pulls the trigger, the free arm of the loaded spring contacts the outer peripheral portion of the disc to eccentrically propel the disc through the launching slot and away from the launcher. U.S. Pat. No. 4,170,215 for a "Disk Toy and Launcher" issued in 1979 to Kettlestrings, purports to disclose a mechanical launcher for a toy disk that has a recess for engaging and bending a leaf spring when loaded. After bending the spring, the disk is received by tabs of catch members in the launcher. When a plunger dislodges the tabs the spring propels the disk away from the launcher.

These patents and devices are of some interest, however, they do not disclose or illustrate a simple, inexpensive, fun to use and robust toy item.

SUMMARY OF THE INVENTION

The present invention relates to very inexpensive toy projectile launchers, which are made of few molded components that integrate many parts and functions. The resulting launchers are of simple but robust construction and may be quickly and easily assembled.

The inventions relates to a hand held toy projectile launch apparatus and methods. The toy projectile launch apparatus includes a hand held first housing, a hand held second housing pivotally connected to the first housing to enable an operator to move the housings toward one another using one hand, a flexible plastic launch spring having upper and lower portions mounted within the housings, the upper portion of the launch spring for engaging and launching a projectile, a mechanism mounted within the housings for causing the launch spring to bend when the first and second housings are brought toward one another by the operator, and a restraint mounted to one of the housings for retraining the upper portion of the launch spring until the launch spring is fully bent. The inventions also relate to a method for assembling a of forming and assembling an inexpensive toy projectile launcher including the steps of forming a flexible plastic launch spring, forming a first housing, forming a second housing, pivotally connecting the first and second housings together, mounting the launch spring in the first and second housings, forming a plastic structure for bending the launch spring, mounting the plastic structure in the first and second housings, and engaging the plastic structure to the launch spring to enable the plastic structure to move the plastic spring between a generally relaxed position to a primed position when an operator moves the first and second housings together.

Briefly summarized, the inventions relate to hand held toy projectile launch apparatus, robust construction and methods accordingly incorporating pivotally connected housings which may be quickly and easily assembled. The hand held toy projectile launchers include a flexible plastic launch spring having engaging portions mounted within the housings to enable an operator to move the housings in relation to one another using one hand, with an end portion of the launch spring for engaging and launching a projectile. The launch apparatus may launch foam darts or foam spheres and each launch apparatus includes an elongated strip-like plastic launch spring that bends when primed so as to provide energy for launch.

BRIEF DESCRIPTION OF THE DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention and its claims.

Figure 1:
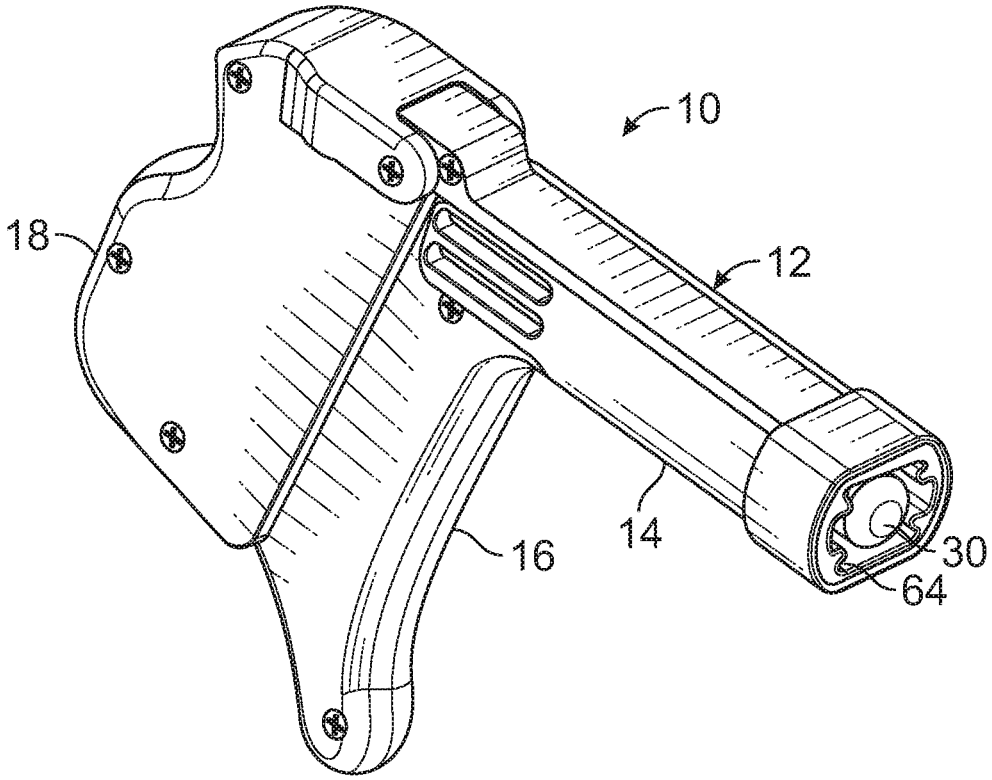
FIG. 1 is an isometric view of one embodiment of an inventive toy launcher apparatus.
Figure 2:
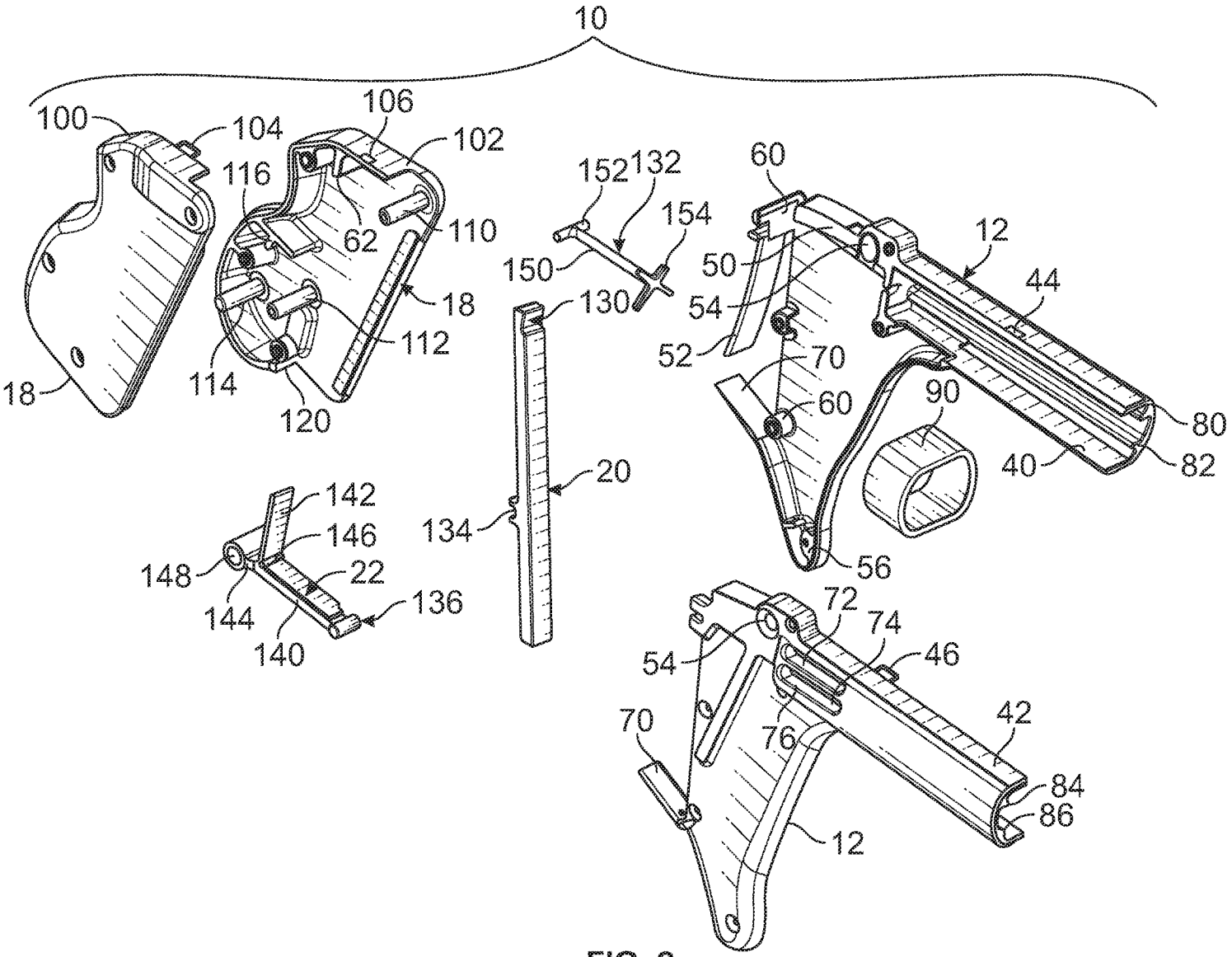
FIG. 2 is an exploded, front looking isometric view of the toy launcher illustrated in FIG. 1.
Figure 3:
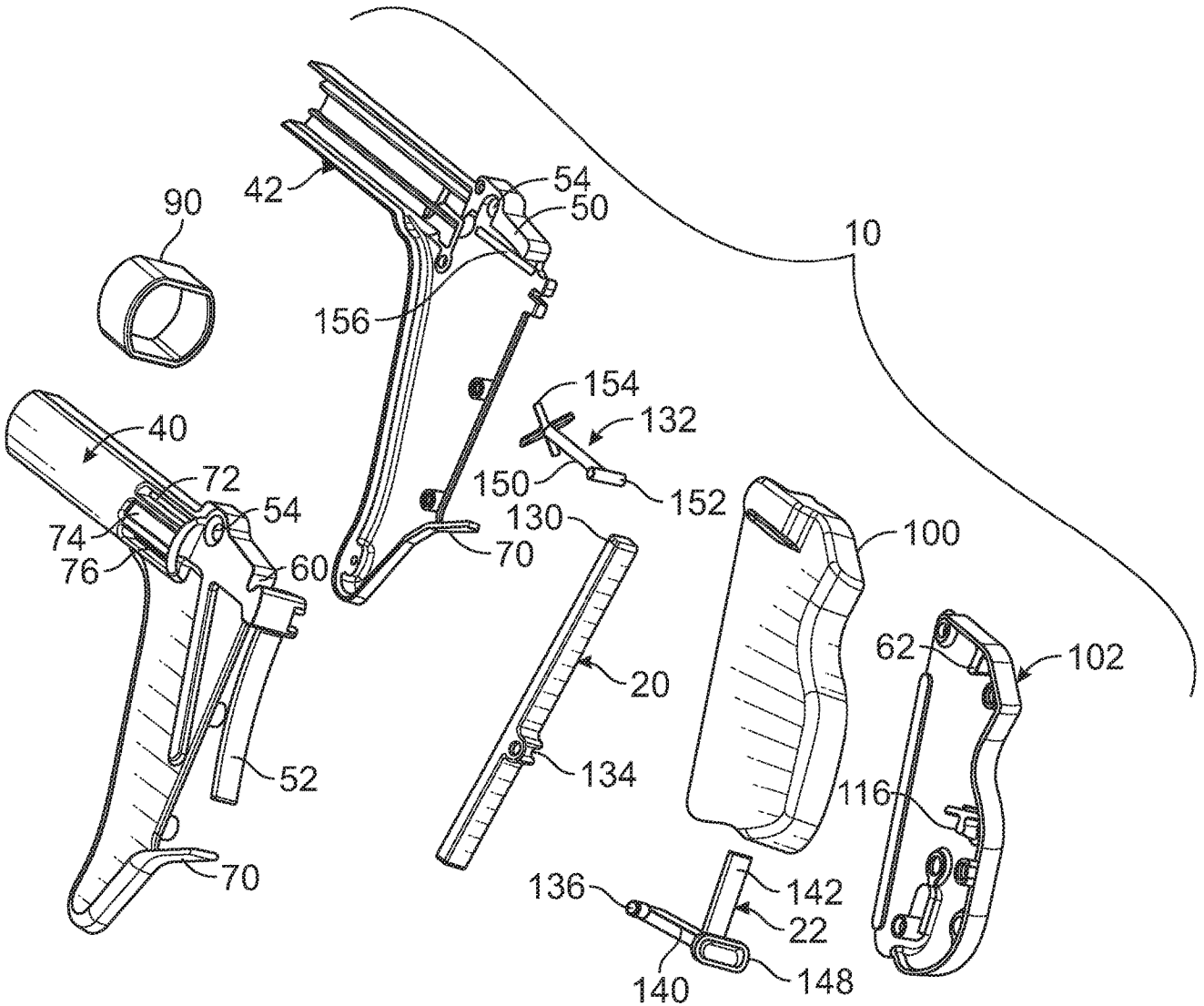
FIG. 3 is an exploded, rear looking isometric view of the toy launcher illustrated in FIGS. 1 and 2.

Referring now to FIGS. 1, 2 and 3, an embodiment of a toy launch apparatus may take the form of a small, inexpensive, plastic toy dart launcher or blaster 10, having only eight primary components made up of many integral parts that are formed of inexpensive plastic and that are easily and quickly assembled. The small dart launcher 10 includes a forward first housing 12 ("forward" is toward the right in FIG. 1) having a barrel portion 14 and a handle portion 16. The launch apparatus also includes a rearward second or trigger housing 18 pivotally connected to the first housing 12, an elongated, strip shaped, flexible, plastic launch spring 20, and a plastic structure for progressively bending or priming the launch spring, as an operator moved the two housings toward each other, the plastic structure being in the form of a push rod 22 pivotally connected to the trigger housing 18 at a back end and pivotally connected to the launch spring 20 at a front end. In the alternative, another mechanism may be used for the structure as will be detailed below.

Figure 4:
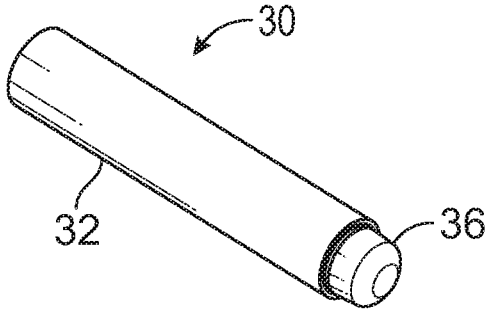
FIG. 4 is an isometric view of a front facing soft foam toy dart.
Figure 5:
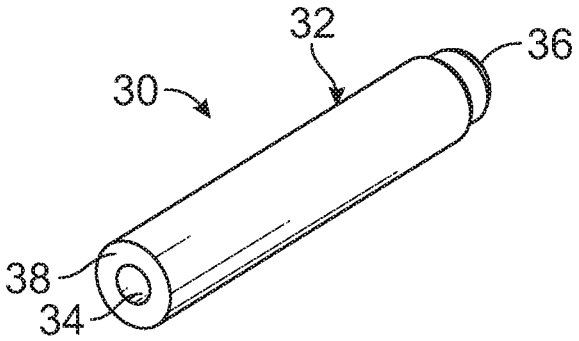
FIG. 5 is an isometric view of the rear of the soft foam toy dart illustrated in FIG. 4.
Figure 6:
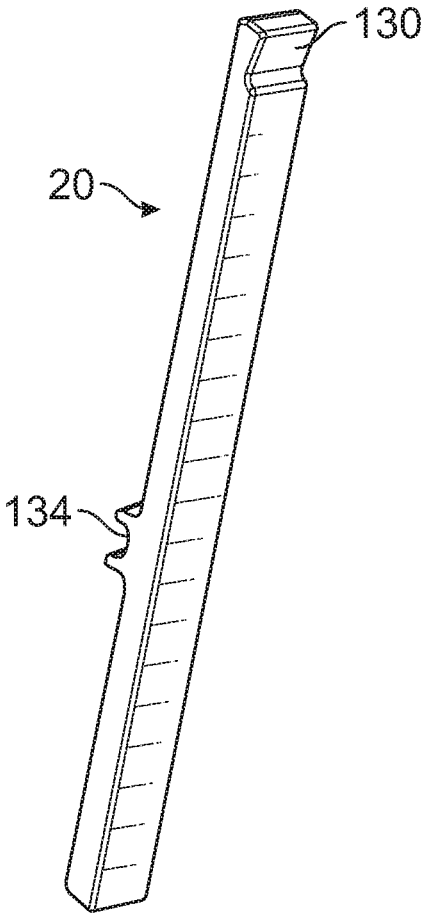
FIG. 6 is an enlarged isometric view of the front of a plastic launch spring of the launch apparatus shown in FIGS. 1-3.

The toy launch apparatus 10 is designed to launch the well-known NERF® brand dart 30, FIGS. 4 and 5. The NERF brand darts may include a soft foam cylindrical body 32 having an open tubular center 34, a denser nose portion 36 and a rear ring-shaped wall 38. Other projectiles may be used such as a variation dart that may have a soft foam body but without an open center. Instead, the dart may have rear fins and a longer range and are know as ULTRA DARTS. Or, as will be disclosed in detail below, the projectile may take the form of a small sphere or ball as will be described below.

The first housing 12 of the launch apparatus 10 may be formed of left and right molded parts 40, 42, FIGS. 2 and 3, that may be attached together with snap-fit connectors, such as a snap fit connector 44, 46, or screws, an adhesive or any other convenient connector or attachment. The first housing 12 may include an integrally molded sear 50 for restraining the plastic launch spring 20 during priming, and an integrally molded return spring 52 to bias the trigger housing 18 away from the first housing 12 once an operator releases the apparatus. The first housing 12 may also include a lateral shaft opening 54 to enable the trigger housing 18 to form a pivotal connection with the first housing 12. A lower protrusion or post 56 may be formed integral with the base housing to restrain a lower portion of the plastic launch spring 20 but allow the launch spring to progressively bend and to move in a generally longitudinal direction when the operator retracts his/her hand during priming. To the rear of the sear 50 is a lateral opening or space 60 to accommodate a spring contacting an upper protrusion 62 molded with the trigger housing 18.

The barrel portion 14 of the first housing 12 includes a forward end 64 for receiving the dart 30 loaded into the barrel portion by an operator. Near the bottom of the first housing 12 there may be a closure portion 70 to prevent a pinch hazard, and near the top of the barrel portion there may be three slot-shaped openings 72, 74, 76, in both the left and right parts 40, 42 to allow air flow during launch of the dart projectile. Integrally molded guide rails 80, 82, 84, 86 may be formed on the interior surfaces of the barrel portion 14 for guiding and supporting the loaded dart 30 and for adding strength to the barrel portion, for allowing air flow around the dart and for centering the forward portion of a safety link to be described below. The guide rails may be molded integral with the left and right molded parts 40, 42. A plastic ring 90 may be mounted on the parts 40, 42 just to the rear of the barrel end 64 to help secure the left and right molded parts 40, 42 together and/or as a stylized touch.

The pivotal trigger housing 18 may also be formed of left and right molded parts 100, 102 that may also be attached by snap fit connectors, such as a snap fit connector 104, 106, screws, an adhesive or any other convenient connector or attachment device. The trigger housing 18 may also include an integrally molded pivot shaft 110 that is received by the shaft opening 54 in the first housing 12 to enable the trigger housing 18 to pivot relative to the first housing 12 when the two housings are moved together by the operator simply squeezing his/her hand while holding the launch apparatus 10. The upper protrusion 62 is received by the lateral opening 60 formed in the base housing 12, the upper protrusion 62 being positioned to push downward on the plastic launch spring 20 during the time that the housings 12, 18 are moved together by the operator. In the middle portion of the trigger housing 18 is an integrally molded spring depressor post 112 for bearing against the return spring 52 of the first housing 12 to increase the return spring's force when returning the trigger housing after a dart has been launched. The increased available force of the return spring 52 enables the trigger housing 18 to return to its relaxed or start position after the housings 12, 18 are released by the operator. The trigger housing 18 also includes an integrally molded push rod mounting shaft 114, a push rod bearing post 116 for biasing the push rod 22 upward, and at a bottom of the trigger housing 18, a guide end 120 that moves parallel to the slide portion 70 of the first housing 12.

Figure 7:
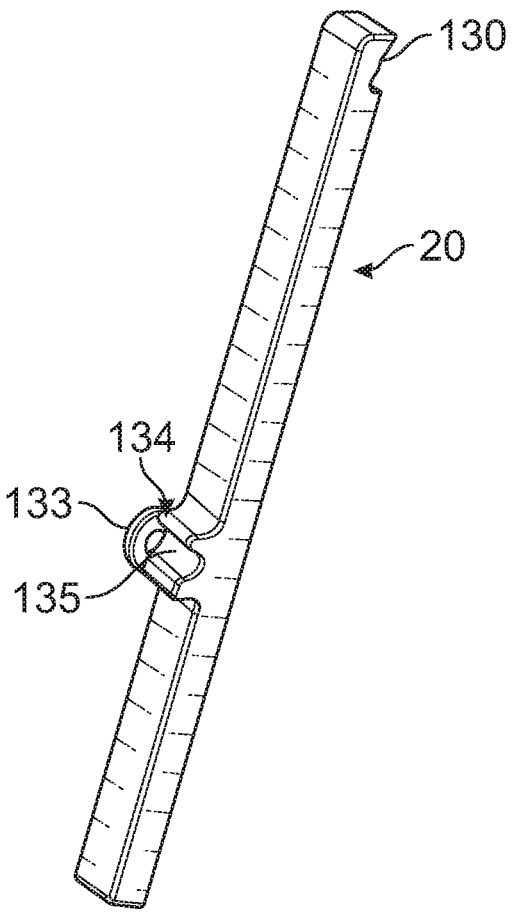
FIG. 7 is an isometric view of the rear of the plastic spring shown in FIG. 6.

The elongated, flexible, plastic launch spring 20 is shaped generally as a strip and is mounted to allow slight longitudinal motion (which is generally in a vertical direction as shown in the drawings) as well as a stress inducing bending motion when operated. At a top portion of the plastic launch spring 20 there may be an indentation or notch 130 for contacting a safety link 132, FIGS. 2 and 3. In a middle portion of the plastic launch spring 20 is one element 134 of a pivotal connector or joint. Another part of the pivotal connector is a tubular element 136, FIGS. 2, 3 and 8, integrally formed on the push rod 22. It is noted that the pivotal connector element 134 may be asymmetrical in that it includes a ring 133, FIGS. 7 and 8, at one end and an open curved surface 135 for the remainder.

Figure 8:
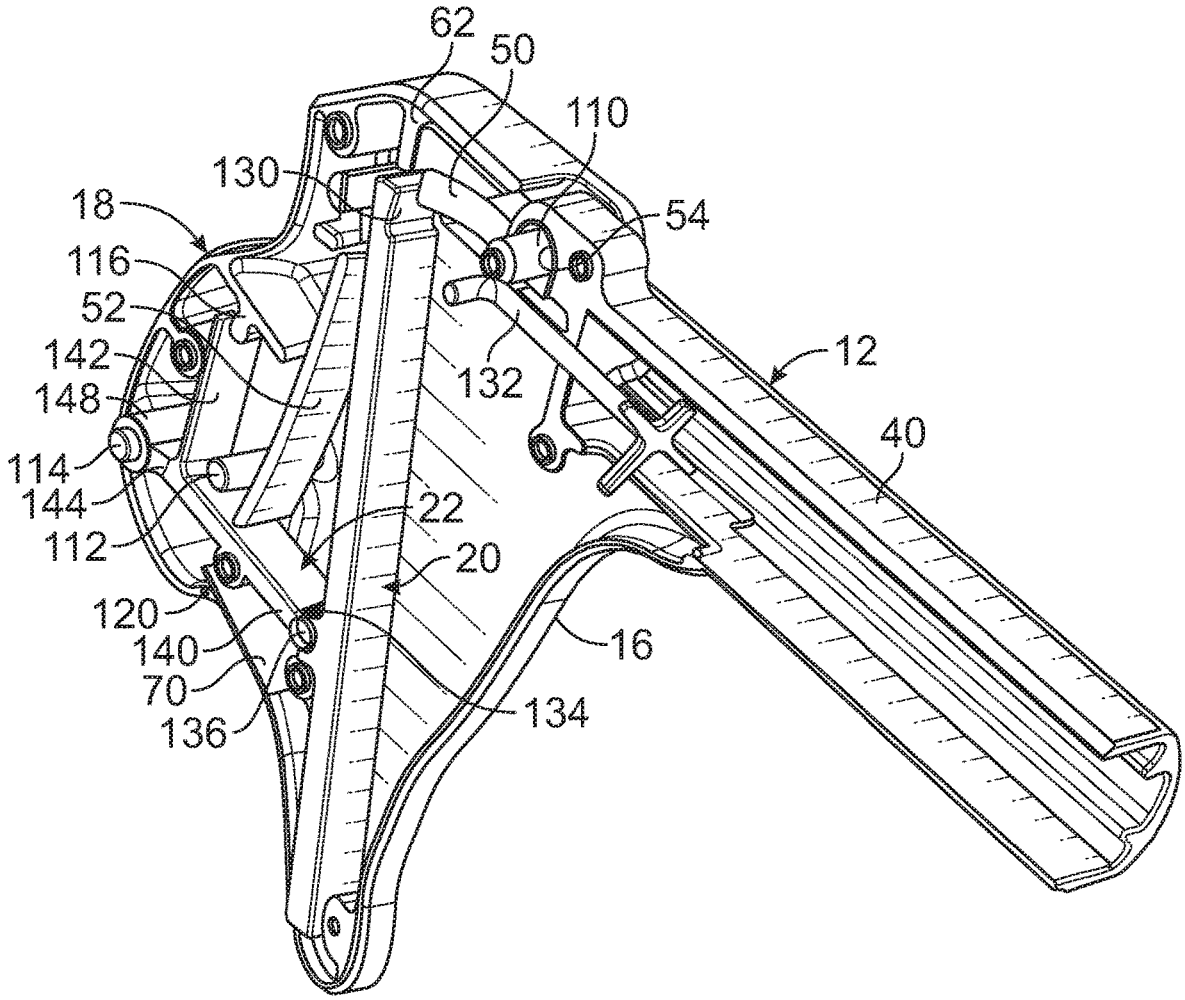
FIG. 8 is an isometric view of the launch apparatus illustrated in FIG. 1, after removing part of the launch apparatus' housings

The push rod 22, FIGS. 2, 3 and 8, is a structure or mechanism including an integral plastic component having a first, general horizontal arm 140 with the tubular end 136 at a distal end, a second, generally upstanding or vertical arm 142 that is restrained by the bearing post 116 of the trigger housing 18, and a short third arm 144 extending rearward from an intersection 146 of the three arms 140, 142, 144. At a rearward or distal end of the third arm 144 is a tubular connector 148 for engaging the mounting shaft 114 molded with the trigger housing 18. During operation, the push rod 22 stresses the plastic launch spring 20 to increase its stored energy as the housings 12, 18 are brought together by the operator. The push rod 22 maintains an upward biasing force on the plastic launch spring 20 to keep contact between the top of the plastic launch spring 20 and the upper protrusion 62. As the housings 12, 18 are brought together by the squeezing of the operator's single hand, the trigger housing 18 pivots and the upper protrusion 62 pushes on the top of the plastic launch spring 20 causing the launch spring to slide away from the restraining sear 50. Once free of the sear, the launch spring will "slap" the safety link 132, which in turn rams into the rear wall 38 of the dart 30 to cause a launch of the dart. In the alternative, the launch spring may directly launch a ball-shaped projectile.

The safety link 132 slides between the barrel portion 14 of the first housing 12 and the notch 130 of the plastic launch spring 20 when the plastic launch spring is restrained by the sear 50. The safety link 132 may include a central rod portion 150 having at a rearward end a cylindrical push element 152 for bearing against the notch 130 in the plastic launch spring 20, and at a forward end, a dart engagement element 154. The push element 152 may ride in opposing slots, of which one slot 156, FIG. 3, is shown, to maintain stability. The dart engagement element 154 of the safety link 132 may be formed to engage the rear wall 38 of the dart 30. However, if the back end of an object loaded into the barrel portion 14 does not have a predetermined configuration, the safety link will not be pushed back to bend the plastic launch spring as desired. In this way, a dangerous object not having the proper configuration, such as a sharp pencil, will not launch. The dart engagement element 154 of the safety link 132 may have an X-shaped configuration, as shown in FIGS. 2 and 3, or a different configuration as a function of the design of the projectile to be launched. The disclosures of U.S. Pat. Nos. 8,875,688 and 5,529,050, are incorporated herein by reference, including figures and description of other safety features. In the alternative, other safety links and projectiles (such as balls, arrows or the like) may be configured to operate with toy launch apparatus similar to those shown and described here.

Figure 9:
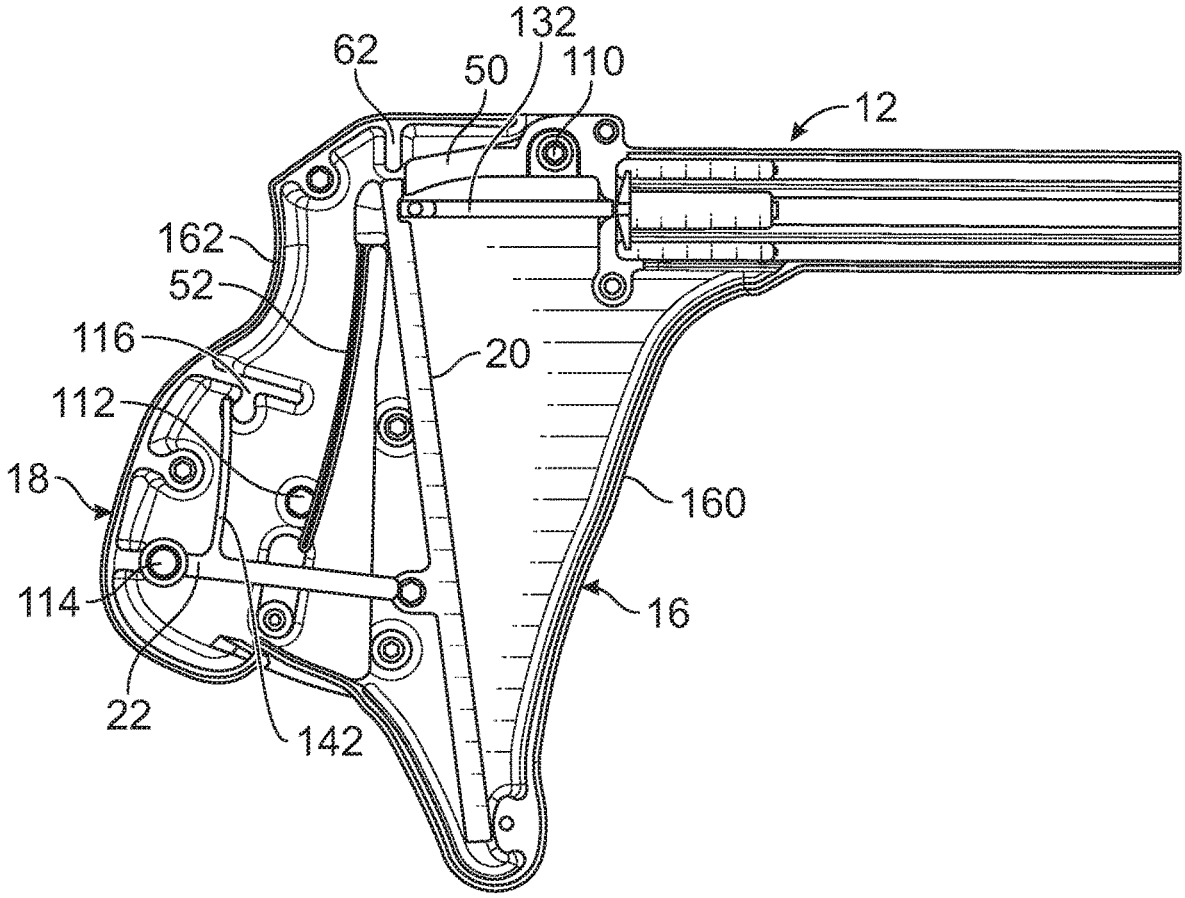
FIG. 9 is a cross-sectional elevation view of the launch apparatus of FIGS. 1-8, showing the plastic spring, a push rod and a return spring, all in relaxed positions.
Figure 10:
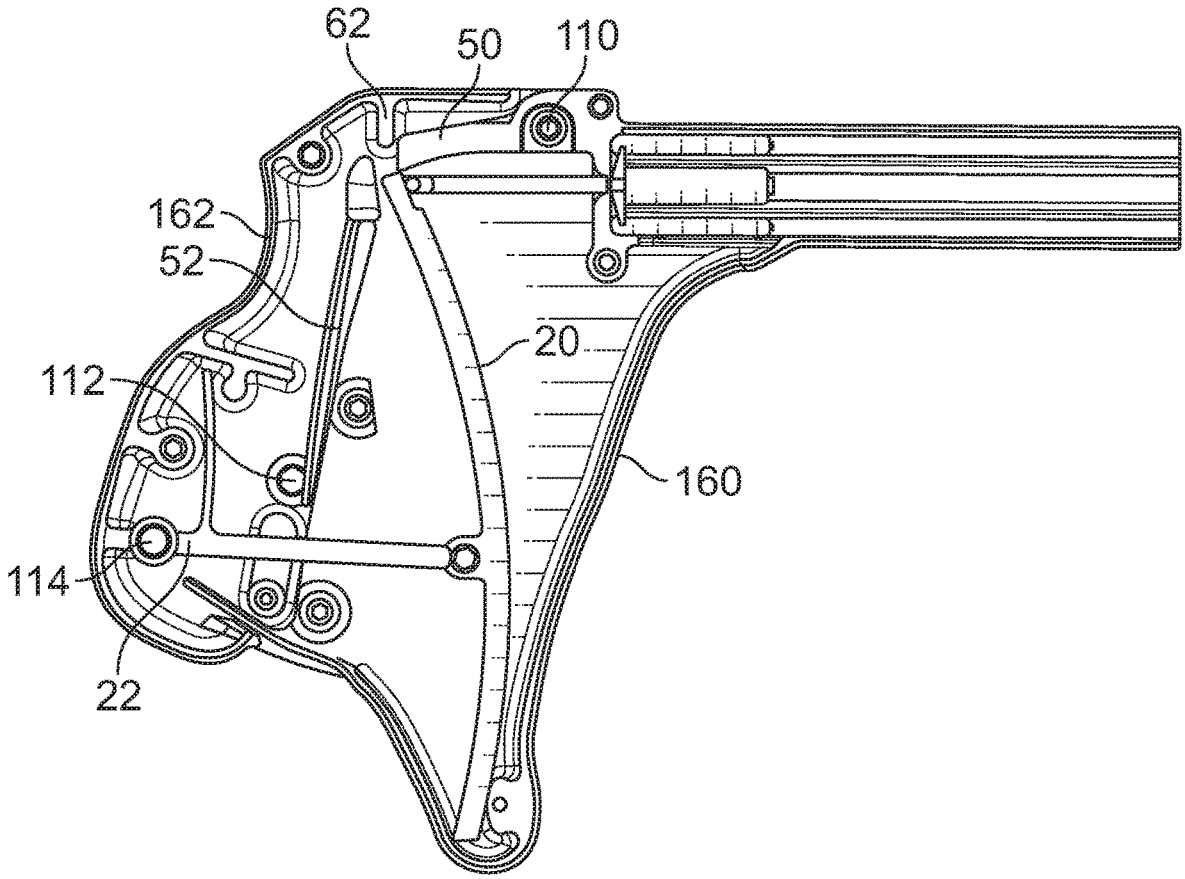
FIG. 10 is a cross-sectional elevation view of the launch apparatus shown in FIG. 9, illustrating the plastic spring in a primed configuration where the spring is fully bent or bowed, and the push rod and the return spring also in primed positions, just before launch of a dart.

In operation, the plastic launch spring 20, FIGS. 8 and 9, is positioned to bear on the sear 50 and be restrained thereby when in the start or relaxed configuration. This arrangement is achieved after a launch by the return spring 52, which is integral with the first housing 12, being sufficiently strong so as to return the trigger housing 18 to its most rearward position as illustrated in FIGS. 8 and 9, once the operator releases his/her grip on the launch apparatus 10. As the trigger housing 18 is moved rearward, the mounting shaft 114 pulls the push rod 22 to the rear (toward the left in the drawings of FIGS. 8 and 9) and that in turn moves the plastic spring rearward 20. A pulling force may be transmitted through the push rod 22 via the asymmetrical connector 134. Once the plastic launch spring moves beyond the sear 50, the upstanding arm 142 of the push rod 22 biases the push rod and the plastic launch spring upwards so as to latch the plastic launch spring 20 behind the sear 50 as illustrated in FIG. 9. During the leftward pivot of the trigger housing 18 and the corresponding movement of the push rod 22, the arm 142 of the push rod 22 bears against the post 116 to bias the plastic launch spring 20 upward to ensure contact of the plastic launch spring 20 and the sear 50. The safety link 132 may be in contact with the plastic spring or may locate itself between the positions illustrated in FIG. 8 and in FIG. 10. In the case where the return spring 52 does not push the trigger housing 18 all the way rearward, insertion of a dart by the operator will push the safety link 132 and the plastic launch spring 20 to the start position, again, as illustrated in FIGS. 8 and 9.

To launch a dart, the operator grips the launch apparatus 10 with one hand where his/her fingers are positioned around a forward edge 160, FIG. 9, of the handle portion 16 of the first housing 12 and his/her palm is positioned around a rearward edge 162 of the trigger housing 18. Typically, the first housing 12 is held stationary while the trigger housing rotates forward. As the operator moves the housings 12, 18 of the launch apparatus together, the trigger housing 18 will pivot forward toward the first housing causing the shaft 114 of the trigger housing 18 to move the push rod 22 forward and slightly downward thereby causing the middle portion of the plastic launch spring 20 to move progressively forward in a bent, curved or bowed configuration because the launch spring 20 is restrained at its top by the upper protrusion 62 and at its bottom by the lower protrusion 56. The connector 148 and the element 136 allow the push rod 20 to translate and pivot during movement of the housing 18. The bow shape increases the induced stress and thereby the energy available to impart to the projectile during launch.

Figure 11:
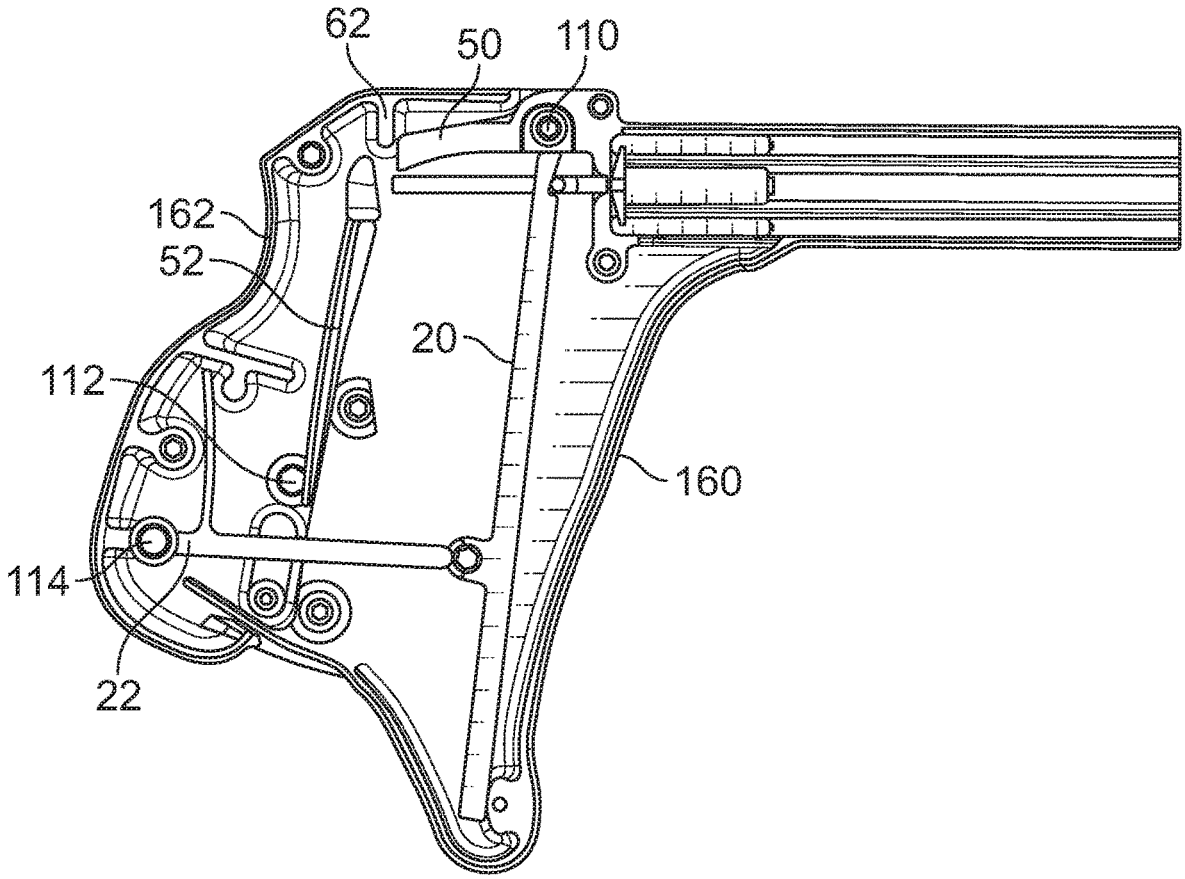
FIG. 11 is a cross-sectional elevation view of the launch apparatus shown in FIGS. 9 and 10, illustrating the plastic spring in a configuration after the launch of a dart.

At the same time, the spring contacting upper protrusion 62 of the trigger housing 18 pivots downward and pushes on the top of the plastic launch spring 20 to result in the plastic launch spring 20 sliding downward away from contact with the sear 50. Thus, the plastic launch spring moves slightly in a longitudinal direction. When the plastic launch spring moves downward away from the sear 50, the upper portion of the plastic launch spring 20 is released and thrusts against the safety link 132, which is turn transmits the launch spring energy to the dart, and the dart is launched. After launch, the launch spring 20 moves to the position shown in FIG. 11. When the operator releases his/her grip on the launch apparatus, the return spring 52 moves the trigger housing 18 rearward causing the push rod 22 to pull the plastic launch spring 20 rearward to the relaxed position shown in FIG. 9.

As may now be appreciated, a simply constructed yet robust launcher has been described and illustrated in detail where the launcher is made of inexpensive material, namely plastic. There are few parts because they are molded as single integral components. The launcher is designed to be quickly and inexpensively assembled resulting in a toy that may be marketed at a very low price.

Figure 12:
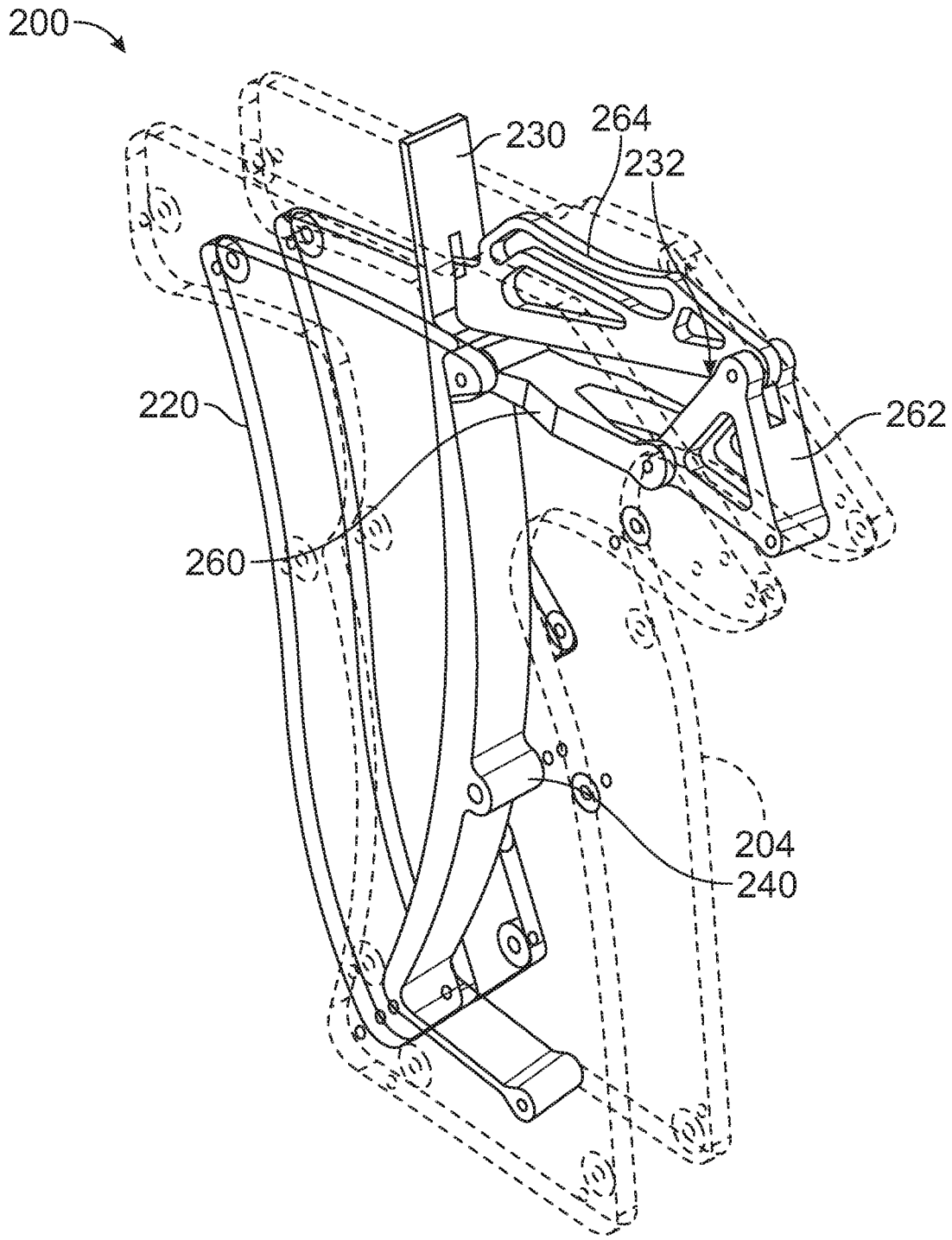
FIG. 12 is an isometric view of another embodiment of an inventive toy launch apparatus with part of the housings in dotted lines.
Figure 13:
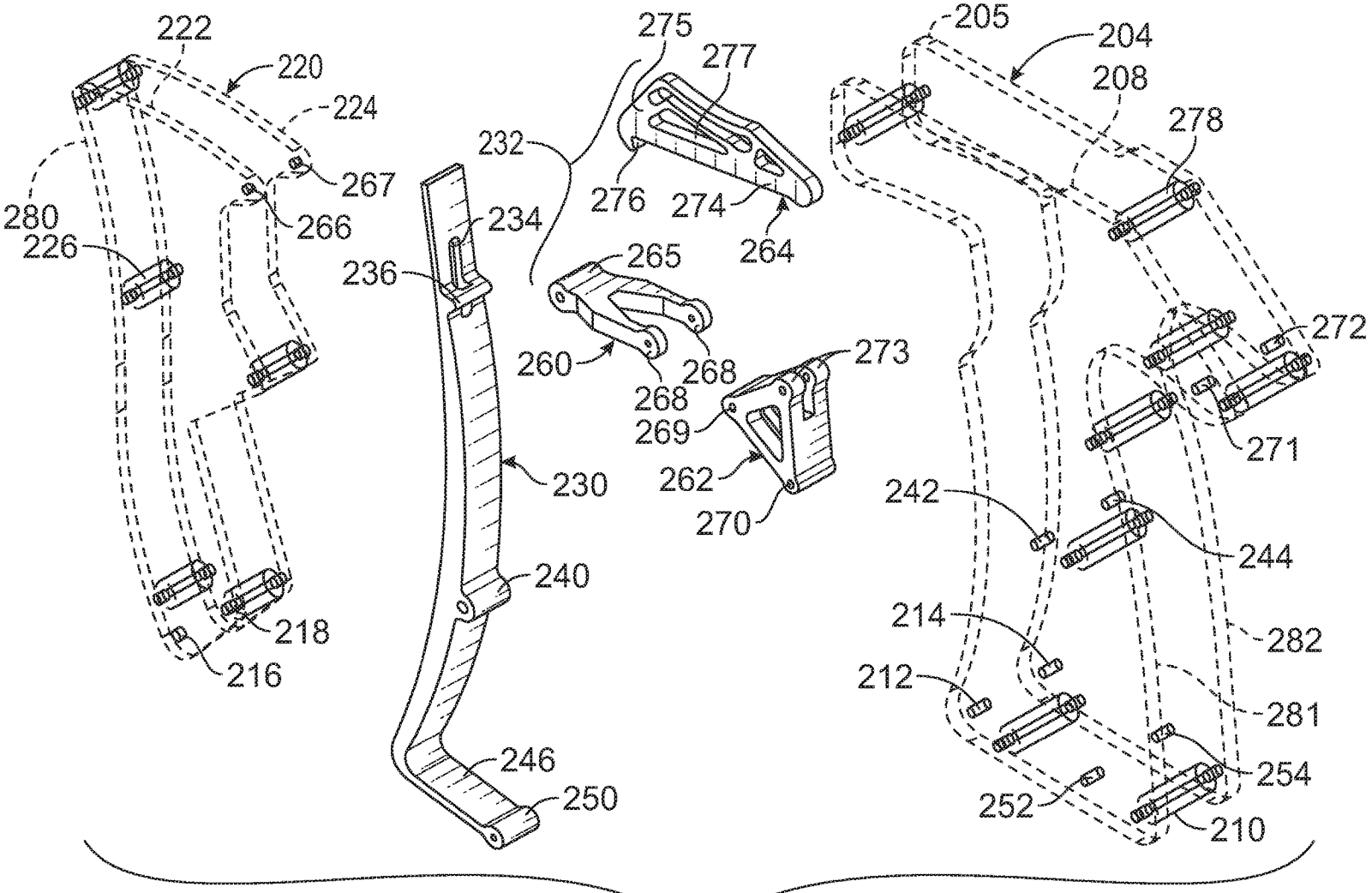
FIG. 13 is an exploded isometric view of the toy launch apparatus illustrated in FIG. 12.
Figure 14:
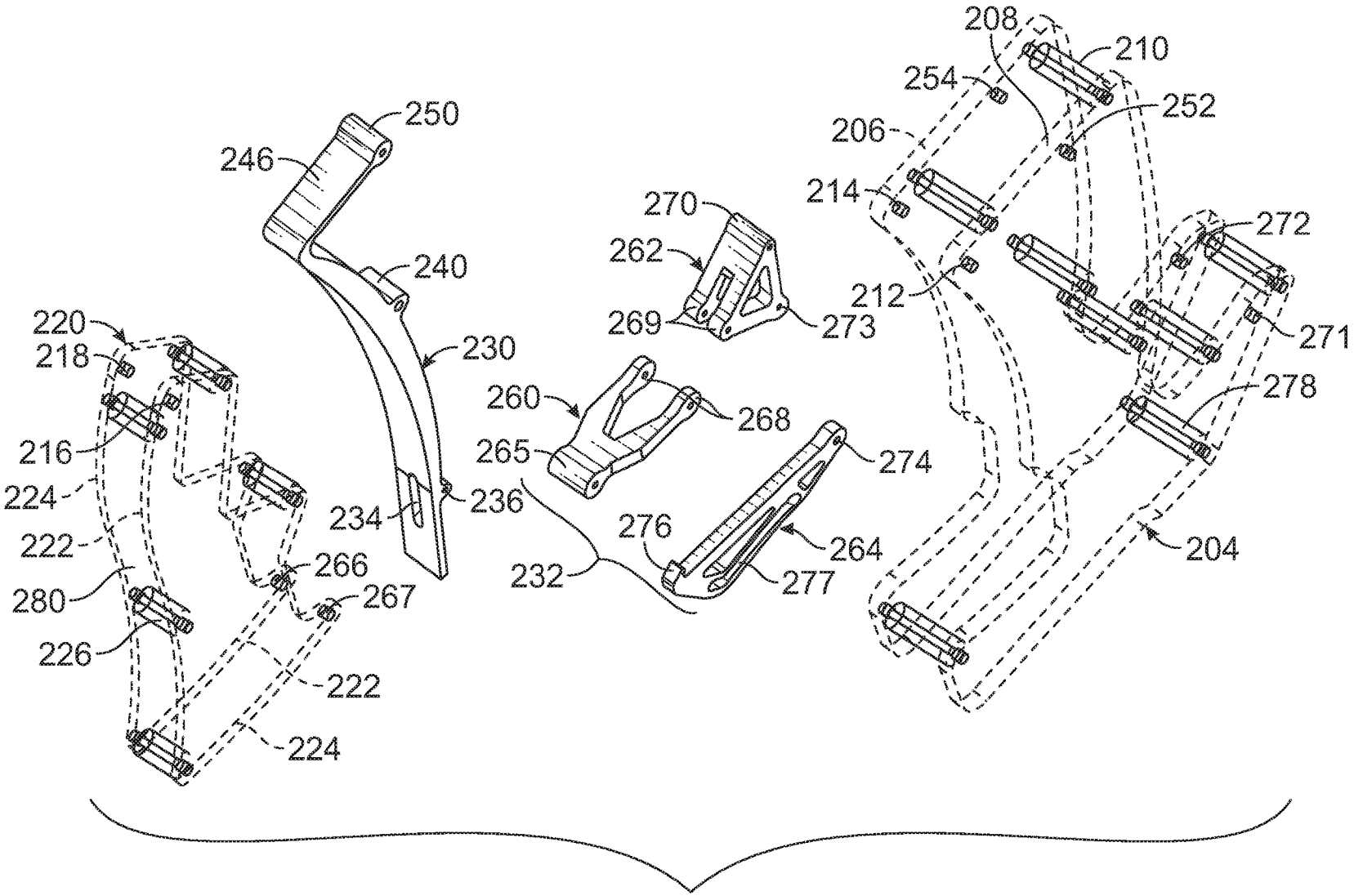
FIG. 14 is an exploded isometric view, upward facing, of the toy launch apparatus illustrated in FIGS. 12 and 13.
Figure 15:
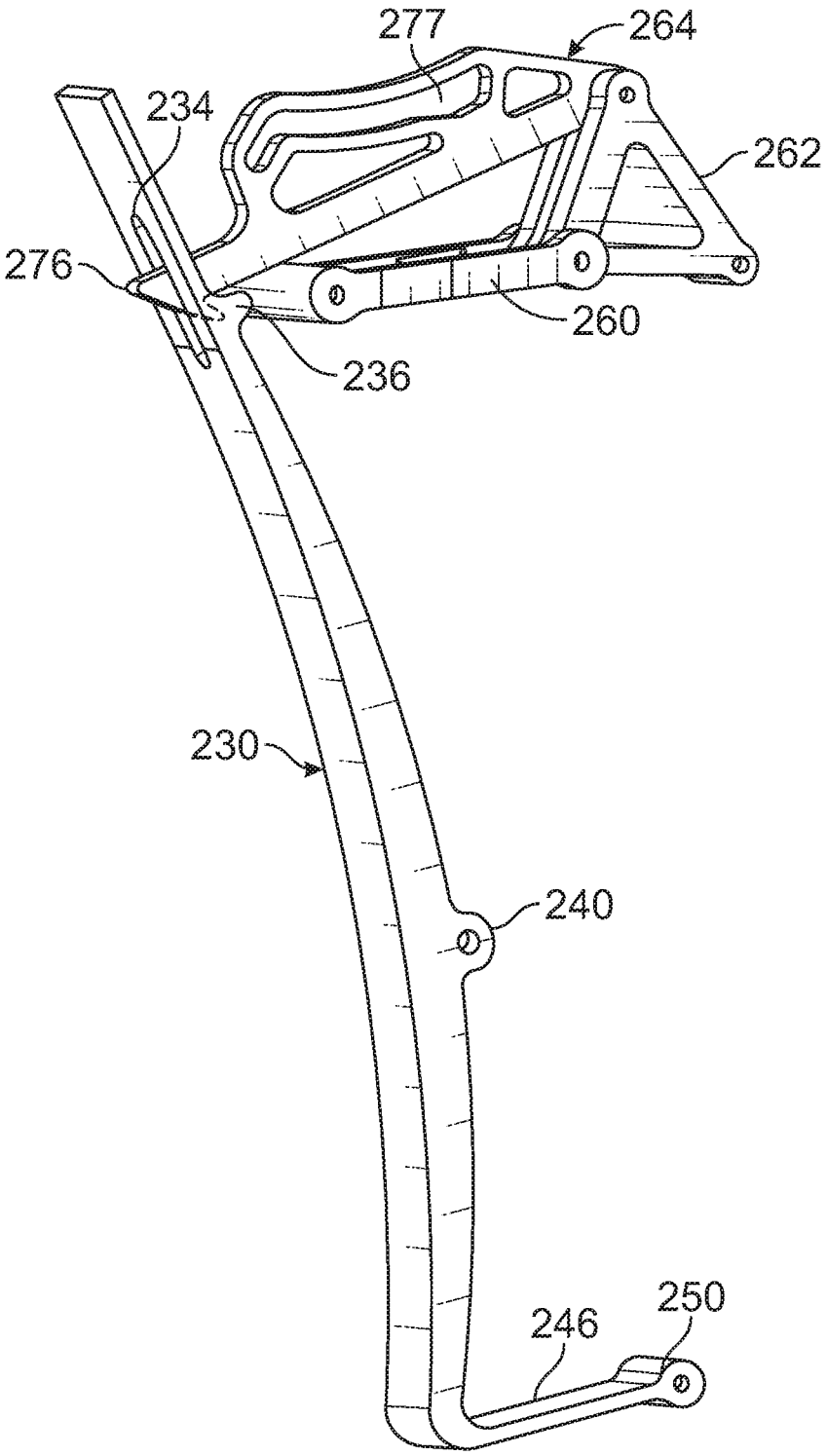
FIG. 15 is an enlarged isometric view of a plastic spring and linkage of the launch apparatus shown in FIGS. 12-14.
Figure 18:
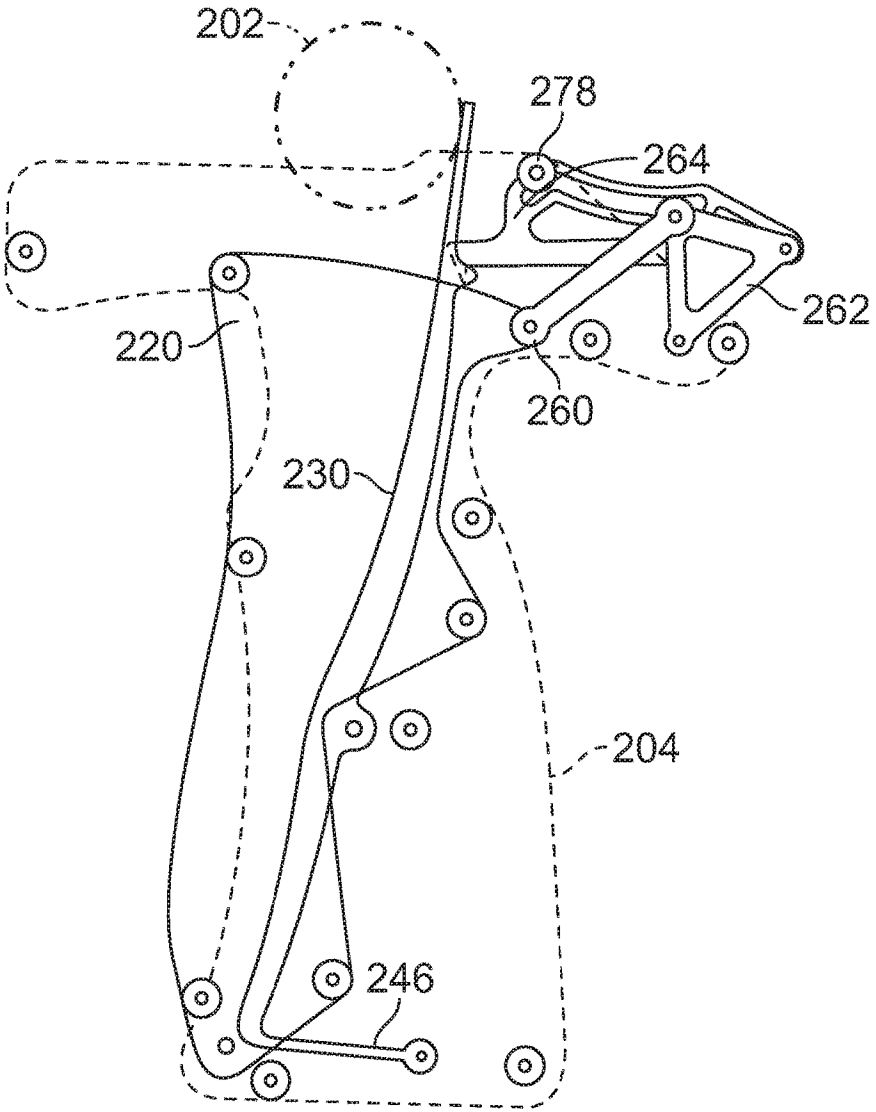
FIG. 18 is an elevation view of the launch apparatus shown in FIGS. 16 and 17, illustrating the plastic spring bent in a fully primed configuration and illustrating a spherical projectile in phantom lines.

Referring now to FIGS. 12, 13 and 14, there is illustrated another embodiment of an inexpensive, all plastic, toy launch apparatus 200 having a plastic launch spring. The launch apparatus 200 is configured to launch spherical projectiles, such as a ball-like foam projectile 202, FIG. 18, drawn in phantom lines, and widely known as a NERF® brand high impact round or ammo marketed under the brand RIVAL ROUNDS. The round 202 is likely to be dropped in position from a projectile magazine (not shown) when the toy launch apparatus 200 is primed for launch (again illustrated in FIG. 18) or hand loaded. The toy launch apparatus 200 includes a first housing 204 that may be formed of spaced-apart left and right panels 206, 208 connected by a series of posts, such as the post 210. Mounted to the base housing 204 may be two small shafts 212, 214 which are received by corresponding openings 216, 218 in a second or trigger housing 220. The trigger housing 220 may also be formed of left and right spaced-apart panels 222, 224 connected together with a series of posts, such as the post 226. Mounted to the first housing 204 are an elongated strip-like plastic launch spring 230 and a launch spring linkage or structure 232. In the alternative, the housings 204, 220 may be formed in a manner similar to the housings variously numbered 12, 18, 40, 42, 100, 102 of the earlier embodiment described in detail above.

The launch spring 230, FIG. 13, is an elongated, L-shaped plastic strip having an upper slot 234 with a connector bridge bar 236, a middle pivotal connector 240 that may receive two shafts 242, 244 formed in the first housing 204. The plastic spring is bent at a sharp angle forming an arm 246. There may be another pivotal connector 250 at the distal end of the arm 246 that may receive two shafts 252, 254 formed integral with the first housing 204. In the alternative, the arm 246 may be thin and allowed slight vertical movement of the bottom of the launch spring.

Figure 17:
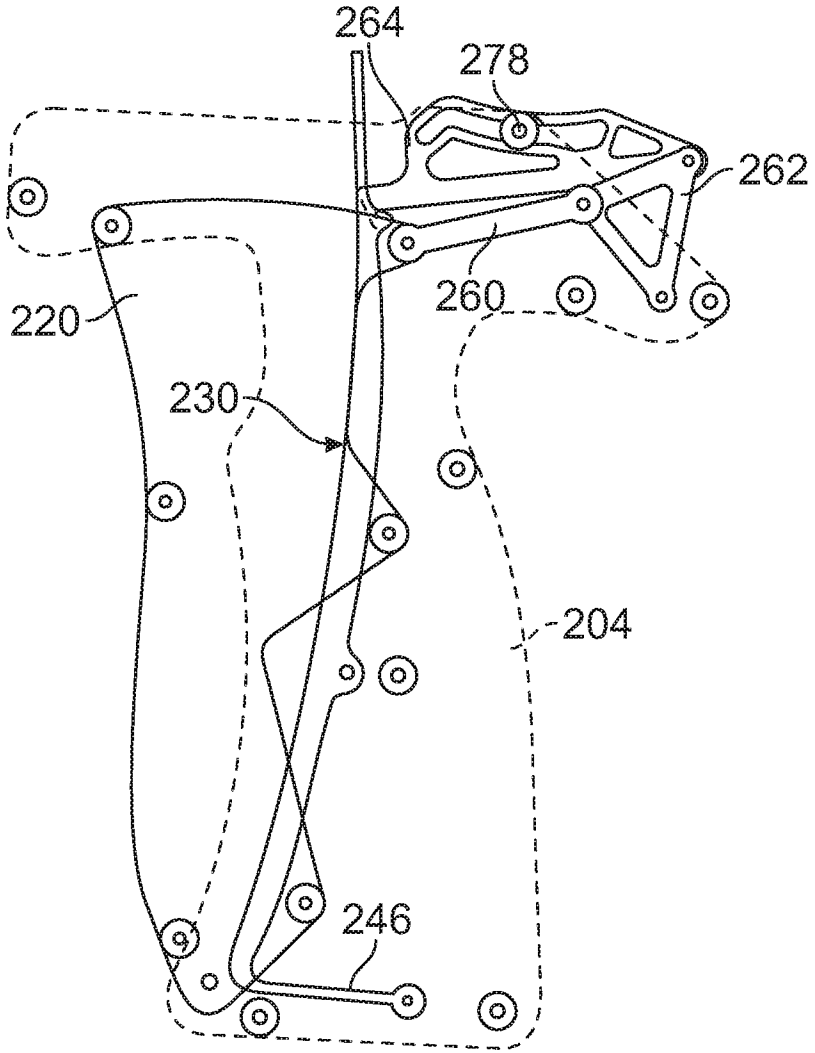
FIG. 17 is an elevation view of the launch apparatus shown in FIG. 16, in a partially primed configuration.
Figure 16:
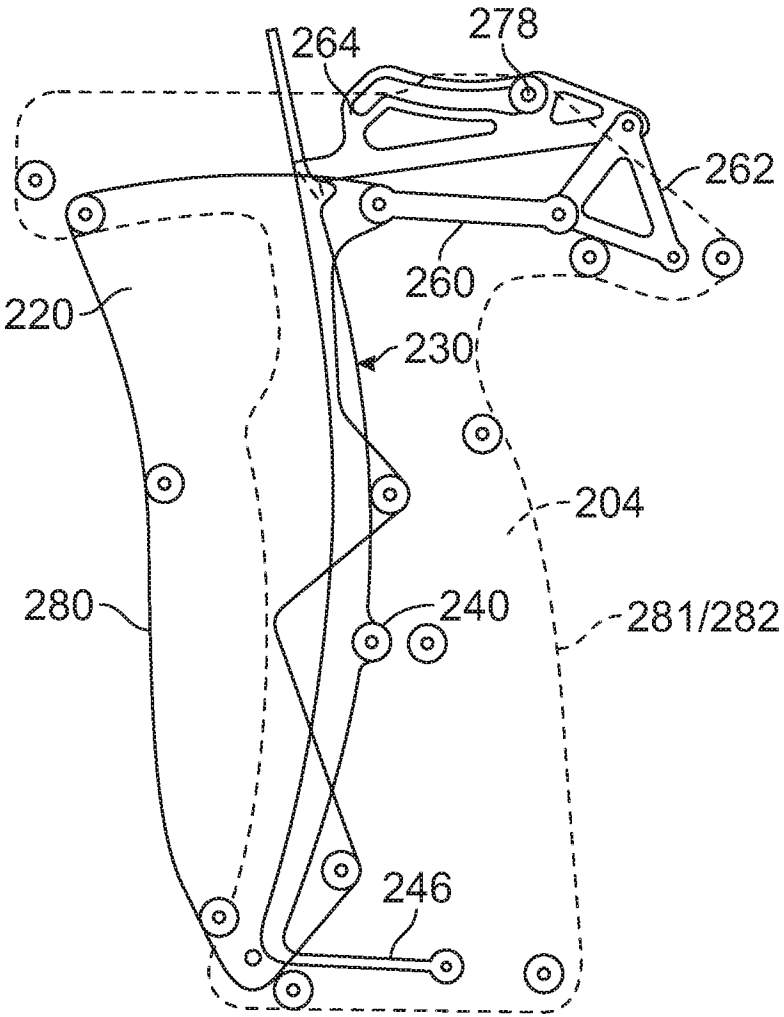
FIG. 16 is an elevation view of the launch apparatus shown in FIG. 12, illustrating the plastic spring and the linkage in a relaxed configuration.

The linkage structure 232, FIG. 14, for operating the launch spring includes three links, an input link 260, a bell-crank middle link 262 and an output link 264. The input link 260 is a fork-like element where a forward end 265 receiving shafts 266, 267 which are integrated with the trigger housing 220, and a rearward end 268 is pivotally connected to a forward apex 269 of the bell crank link 262. The bell crank 262 may have a triangular shape where a second apex 270 is pivotally connected to shafts 271, 272 integral with the base housing 204. A third apex 273 is connected to a rearward end 274 of the output link 264. At a forward end 275 of the output link 264 is a hook 276 that is engaged to the bridge bar 236 of the launch spring 230. At an upper portion of the output link 264 is a curved slot 277 that acts as a cam follower to a cam pin 278 on the first housing 204. When the launcher is just about fully primed or cocked, the cam pin 278, FIG. 16-18, lifts the output link 264 causing the hook 276 to disengage from the bridge bar 236. This arrangement allows the energy of the stressed launch spring 230 to be released, causing the launch spring 230 to slap the round 202 like a bat hitting a baseball and thereby transfer the spring's energy to the round resulting in a launch. The primary purpose of the multi-link and bell-crank linkage 232 is to create a high motion ratio between the trigger housing and the bridge bar 236 at the beginning of the priming stroke and transition to a low motion ratio toward the end of the priming stroke in order to create a more consistent pull force throughout the priming stroke.

In operation, an operator may grip the launch apparatus 200 with one hand where his/her fingers go around a forward wall 280 of the trigger handle 220 and his/her palm presses against rear surfaces 280, 282 of the first housing 204. When the operator pulls back with his/her fingers, the trigger housing 220 pushes the input link 260 rearward, causing the bell crank link 262 to rotate about the second apex 270 resulting in the output link 264 moving rearward. Because the hook 276 is engaged to the bridge bar 236 through the slot 234 in the plastic launch spring 220, the plastic launch spring is pulled rearward (to the right in FIGS. 16-18). At the end of this priming step the cam pin 278 lifts the output link 264, which causes the hook 276 to disengage from the stressed plastic launch spring 230 allowing the launch spring to smack against the round 202 causing the round to launch.

In the alternative, instead of mounting the plastic launch spring to pivotal connectors, the launch spring may be fixed at its lower portion.

Figure 19:
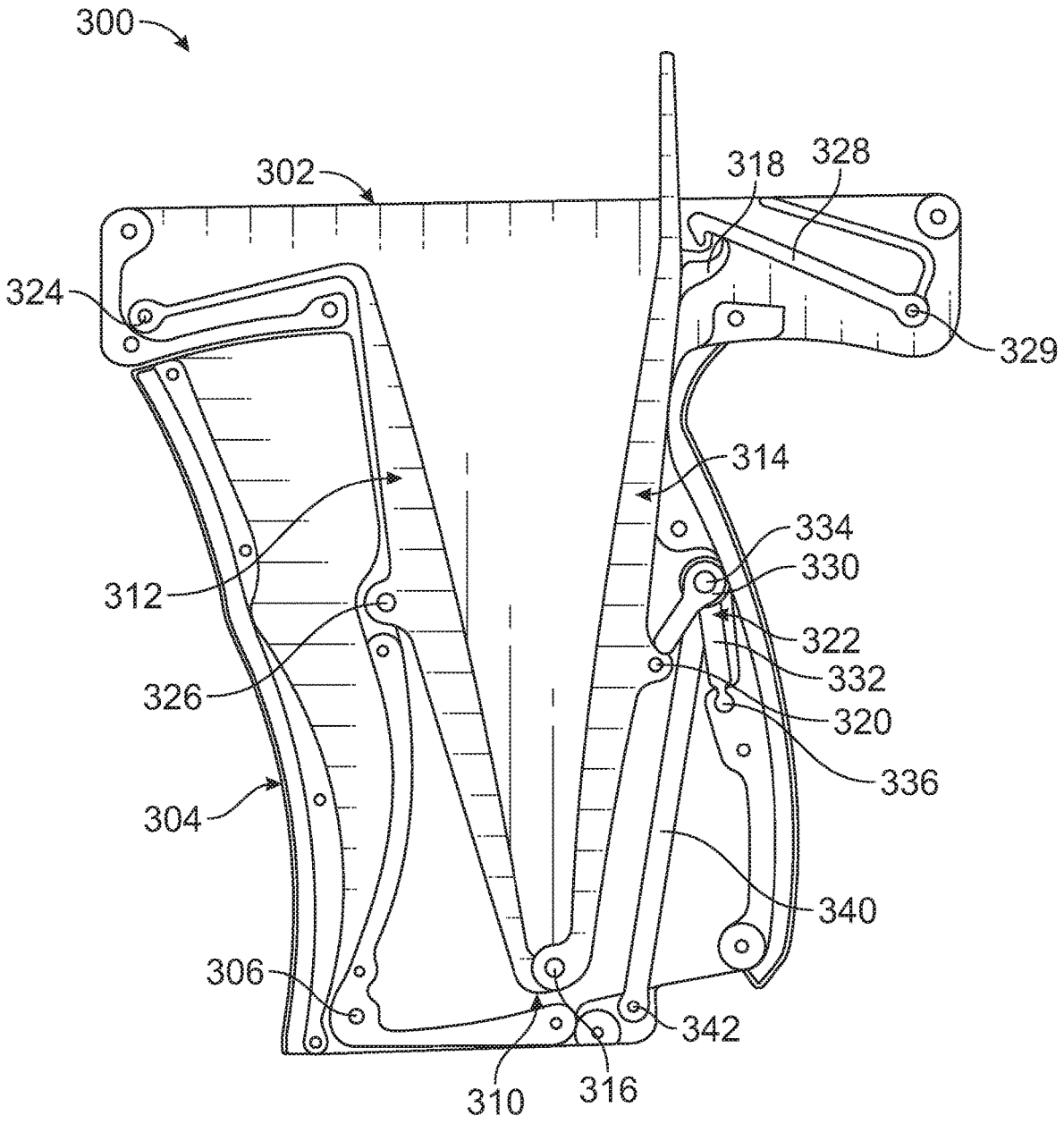
FIG. 19 is an elevation view of the interior of yet another embodiment of an inventive toy launch apparatus illustrating a two-part plastic launch spring in a relaxed configuration.
Figure 20:
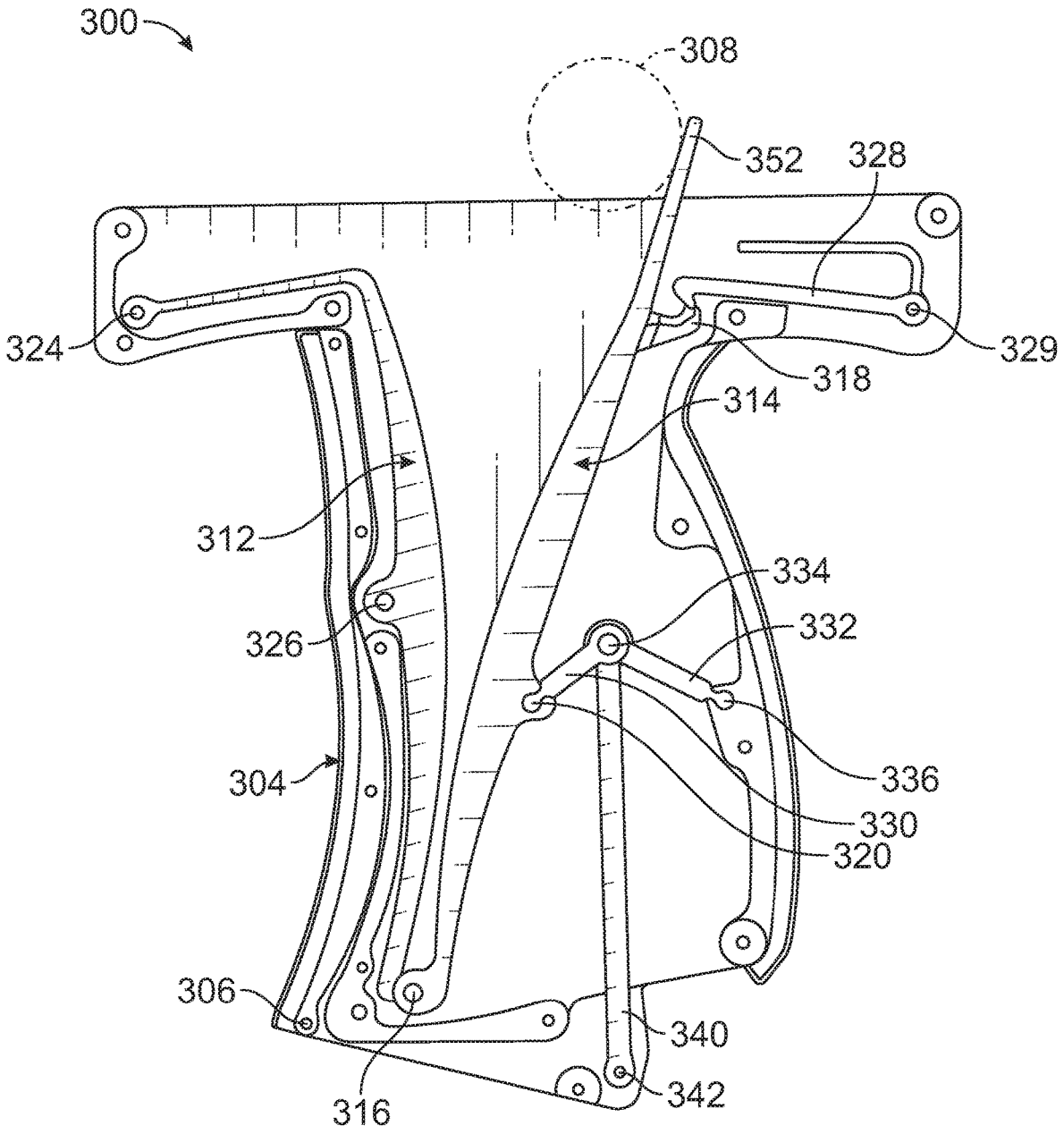
FIG. 20 is an elevation view of the launch apparatus shown in FIG. 19, illustrating the two part plastic spring in a primed configuration and a spherical projectile in phantom lines.
Figure 21:
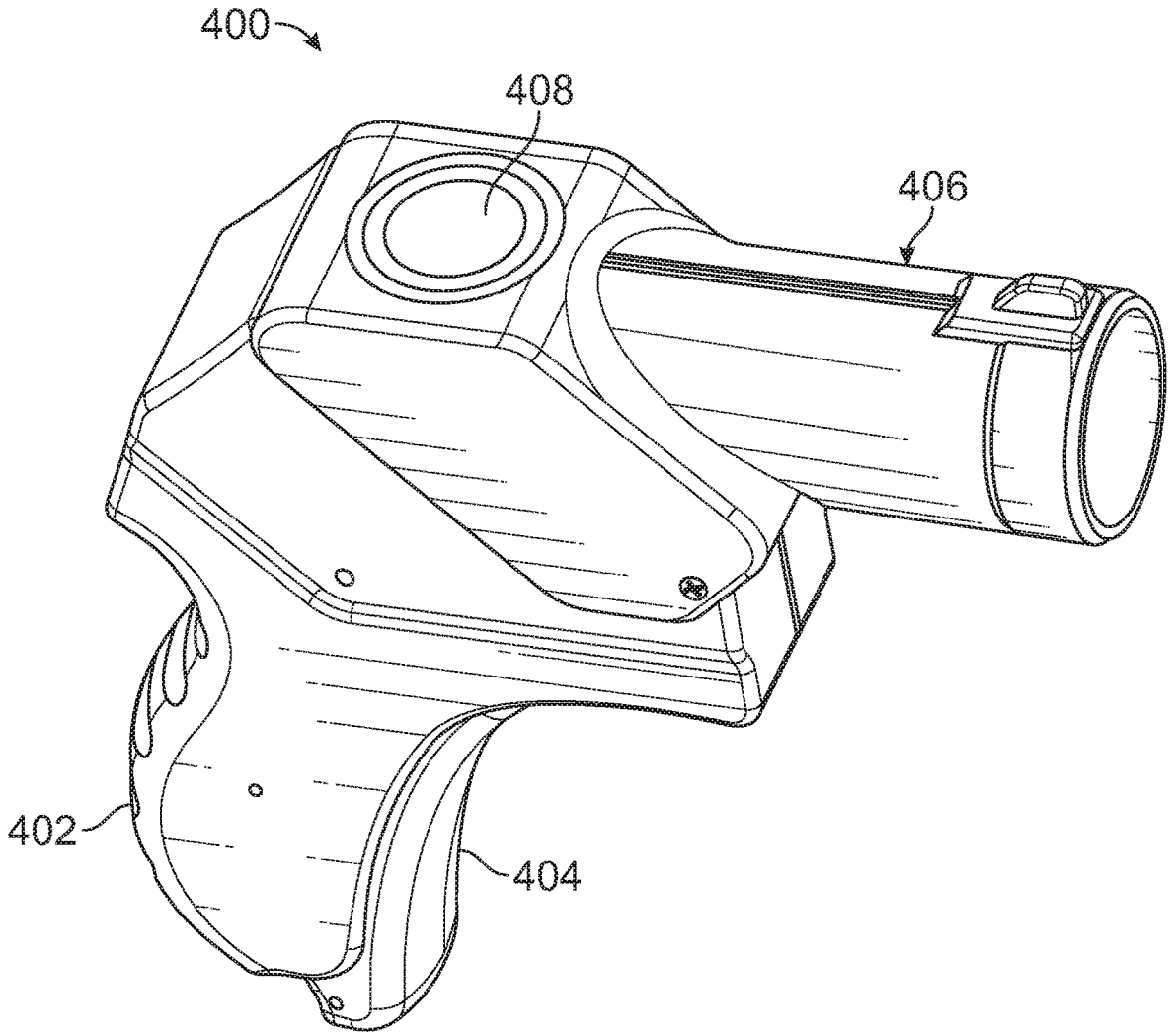
FIG. 21 is an isometric view of still another embodiment of an inventive toy launch apparatus, this embodiment having a projectile loading port.

A third embodiment of the present is a toy launch apparatus 300 illustrated in FIGS. 19 and 20, and includes a first housing 302 and a second or trigger housing 304 which are pivotally connected together at a lower connector 306. The launch apparatus 300 is designed to launch rounds, such as a round 308 illustrated in phantom lines in FIG. 20. The housings are constructed in a manner similar to the toy launch apparatus 200, shown and described in relation to the figures in FIGS. 12-18, but with a different launch spring arrangement. A plastic launch spring 310 is illustrated in FIGS. 19 and 20, and includes two parts, a forward, strip-like spring element 312 pivotally joined to a rearward, strip-like spring element 314 at a lower pivotal connector 316 to enable the rearward spring element 314 to slide or move in a generally longitudinal direction and compound the amount of stress induced.

The rearward spring element 314 is elongated and formed of a resilient plastic and includes a hook 318 near its upper portion, an opening in a middle portion for a pivotal connector 320 which joins the rearward spring element to a linkage 322, and in the lower portion an opening to join the pivotal connector 316. To emphasize, this arrangement allows the rearward spring element 314 to bend and to slide or move in a generally longitudinal direction, which in FIG. 20, is generally upward and downward. The forward spring element 312 is formed of a resilient plastic and is also elongated with a generally upside-down L-shape. The forward spring element 312 is attached to the first housing 302 at a top end connector 324, and also pivotally attached to the first housing 302 at a middle connector 326. The forward spring element 312 is connected to the rearward spring element 314 at the lower pivotal connector 316. This arrangement enables the forward spring element to bend and the rearward spring element to bend and also to slide upward and downward.

The hook 318 of the rearward spring element engages a latch 328 mounted to base housing 302 at a connector 329. The linkage structure 322 includes two links 330, 332 connected at a pivotal connector 334 at one end of each, and the link 330 is pivotally connected to the rearward spring element 314 at the other end by the pivotal connector 320. The link 332 is pivotally connected to the first housing 302 at its other end through a connector 336. A pull rod 340 is connected at one end to the trigger housing 304 at a pivotal connector 342 and at another end to the pivotal connector 334 and thereby to the linkage 322.

In operation, a NERF round 308 may be placed on the rearward first housing 302 forward of an upper portion 352 of the rearward spring element 302 from a projectile magazine (not shown) or individually by hand. When an operator squeezes his/her hand, his/her fingers on the trigger housing 304 while holding the first housing 302 with his/her palm, the trigger housing 304 rotates around the pivotal connector 306 causing the pull rod 340 to lower the pivotal connector 334 between the links 330, 332. The linkage structure or mechanism 322 expands and moves the rearward spring element 314 forward causing the pivotal connector 316 to flex the forward spring element 312 increasing its potential energy. At the same time, the rearward spring element 314 is pulled lower causing the hook 318 to disengage from the latch 328 and thereby transfer the energy of both spring elements 314, 321 to the round 308.

Still another preferred embodiment is disclosed here in detail with reference to FIGS. 21-40. This embodiment is a further illustration of the many different designs, shapes, variations and alternatives that may be used for apparatus that launch projectiles. The inventive launch apparatus 400, FIGS. 21-40, includes a first or grip housing 402, a second or trigger housing 404 and a barrel housing 406. In an opposite fashion to the embodiment of FIG. 1, the grip housing 402 will typically fit into the palm of an operator and the trigger housing 404 will be operated by fingers of the operator's hand to pivot the trigger housing 404 relative to the grip housing 402, when the operator wishes to launch a projectile. The preferable projectile for the launch apparatus 400 is a NERF soft foam ball or "RIVAL ROUND" like that illustrated in FIGS. 18 and 20 in phantom lines. The barrel housing 406 includes a top opening or port 408 to enable the operator to load the launch apparatus 400 through the port 408.

In the alternative, other projectiles may be use with slight modification of the design of the launch apparatus 400. The grip housing 402, the trigger housing 404 and the barrel housing 406 may be made of a suitable moldable plastic and formed with left and right halves that may be joined by any suitable fasteners, such as screws, or may be joined by integral snap-fit connectors or by an adhesive.

Figure 25:
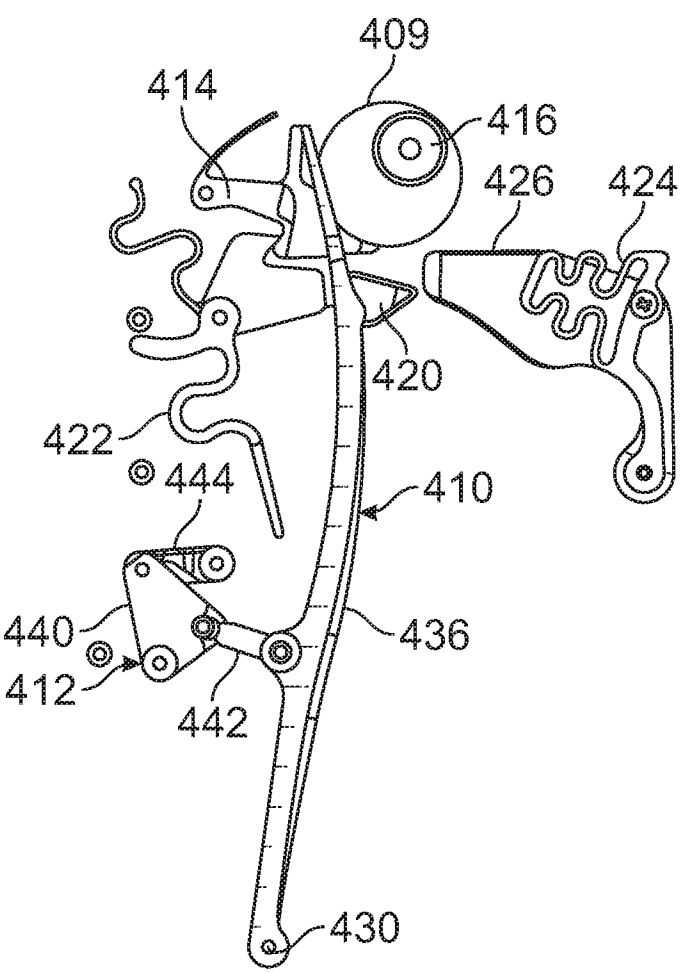
FIG. 25 is an elevation view of internal components of the launch apparatus illustrated in FIG. 21, showing the launch spring in a bent or primed configuration and a loaded spherical projectile.

It is to be noted that the desired features of the launch apparatus 400 include an inexpensive and compact design, a limited travel of the trigger housing 404 relative to the grip housing 402, and a relatively low priming or cocking force require from the operator, all combined to achieve a target velocity of about ninety feet per second for a ball projectile 409, FIG. 25.

Figure 22:
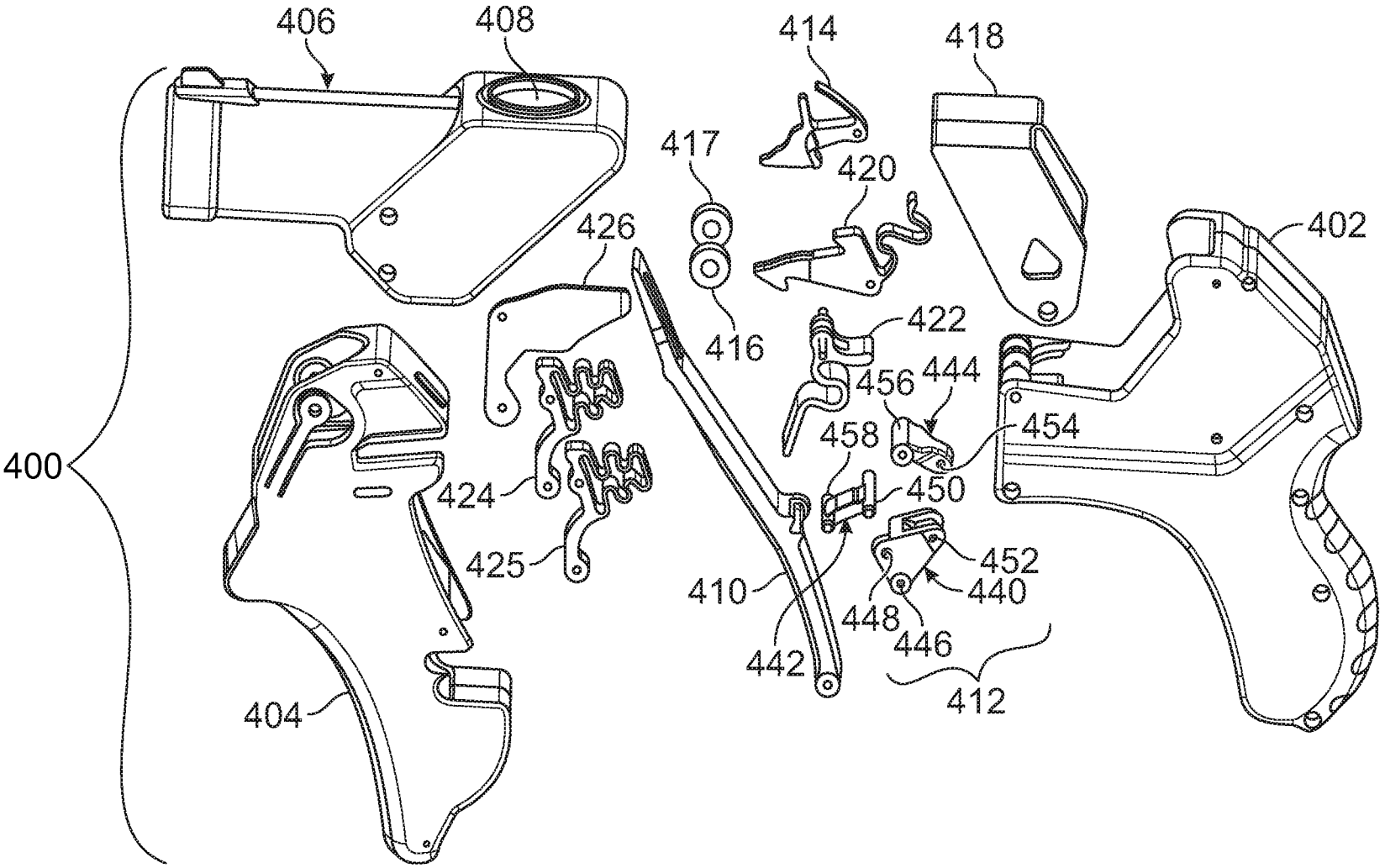
FIG. 22 is an exploded isometric view of the launch apparatus illustrated in FIG. 21.

Within the housings 402, 404, 406 are several components including a launch spring 410, FIG. 22, a bell-crank assembly 412, a ball sensor 414, two ball retainers 416, 417, a port closure element 418, a trigger hook or latch 420, a trigger housing return spring 422, and a pair of launch spring bumpers 424, 425, which are separated by an divider 426.

The launch spring 410, FIGS. 22-25 is similar to the spring 20, FIG. 1, and to the spring 230, FIG. 13, and may be made of any suitable plastic such as DELRIN having a length of about 5.3 inches, a width of about 0.75 inches and a thickness of about 0.15 inches at the lower end, about 0.25 inches in the center portion, about 0.15 inches in the upper portion tapering down to about 0.06 inches at the top of the launch spring. The launch spring 410 is pivotally mounted to the grip housing 402 at a lower spring end 430 and is positioned to impact a NERF ball with the launch spring's upper portion 432.

Figure 24:
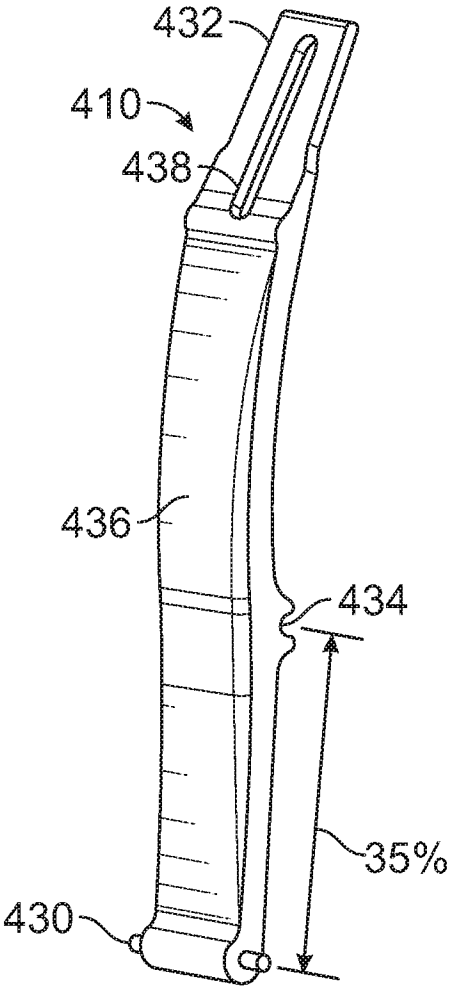
FIG. 24 is an isometric view of the front of the flexible launch spring of the launch apparatus illustrated in FIG. 23.
Figure 23:
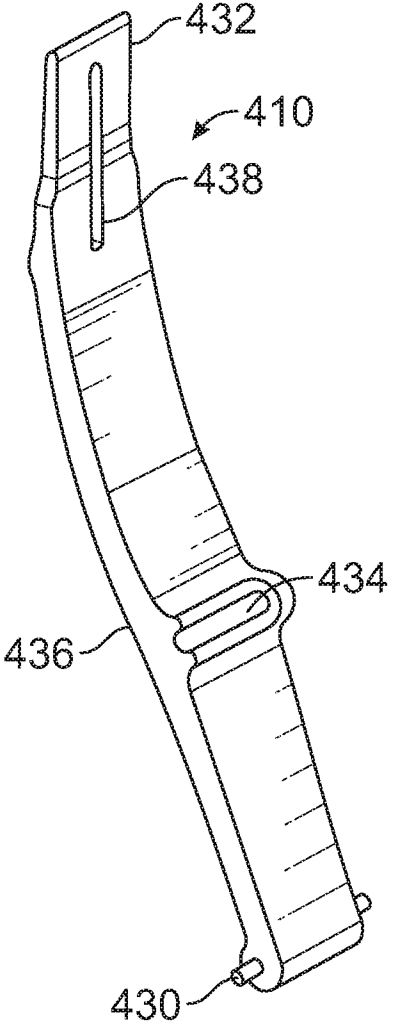
FIG. 23 is an enlarged isometric view of the rear of a flexible launch spring of the launch apparatus illustrated in FIGS. 21 and 22.

At a joint 434 on the launch spring, the launch spring 410 may be connected to the bell-crank assembly 412 which primes or cocks the launch spring by causing the launch spring to bend or bow at its middle section 436 (and thus increase the energy stored at the upper portion 432 available to launch a projectile). The upper portion 432 includes a slot 438 through which the trigger hook 420 extends to maintain the upper portion stationary during the time the bell crank assembly 412 and the trigger housing 404 prime the launch spring. The lower end 430 of the launch spring is pivotally connected to the trigger housing 404. When the length of the launch spring is about 5.28 inches, the joint 434 is about 1.84 inches from the spring end pivot 430, the distance from the spring end pivot to the trigger hook 420 is about 3.98 inches and from the spring end pivot 430 to a centerline of the ball is about 4.9 inches. Therefore, the joint 434 is about thirty-five percent of the total length of the launch spring when measured from the spring end pivot 430 as illustrated in FIG. 24.

Figure 26:
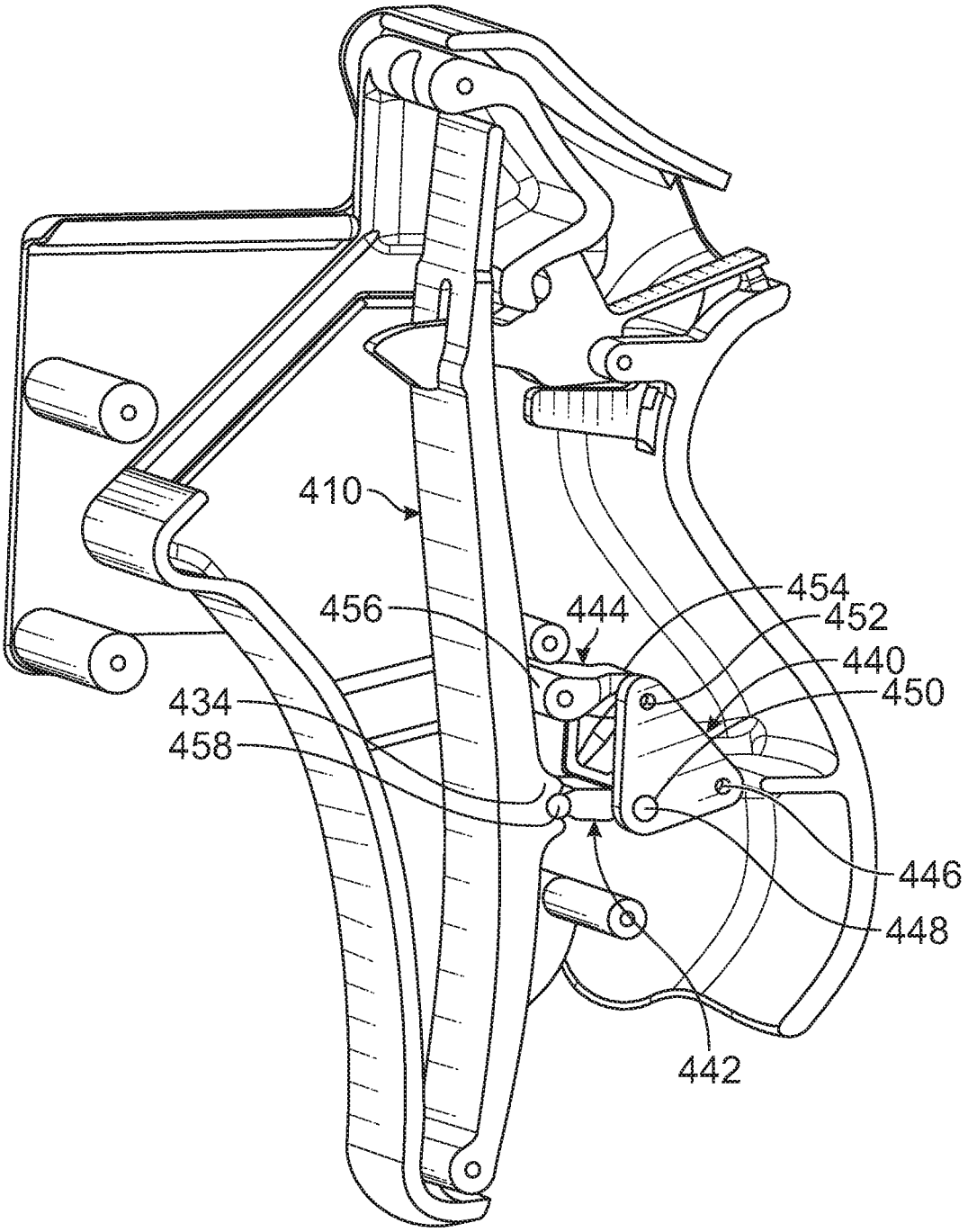
FIG. 26 is a diagrammatic isometric view of a bell crank of the launch apparatus illustrated in FIGS. 21 and 22, showing the launch spring in a relaxed configuration.
Figure 27:
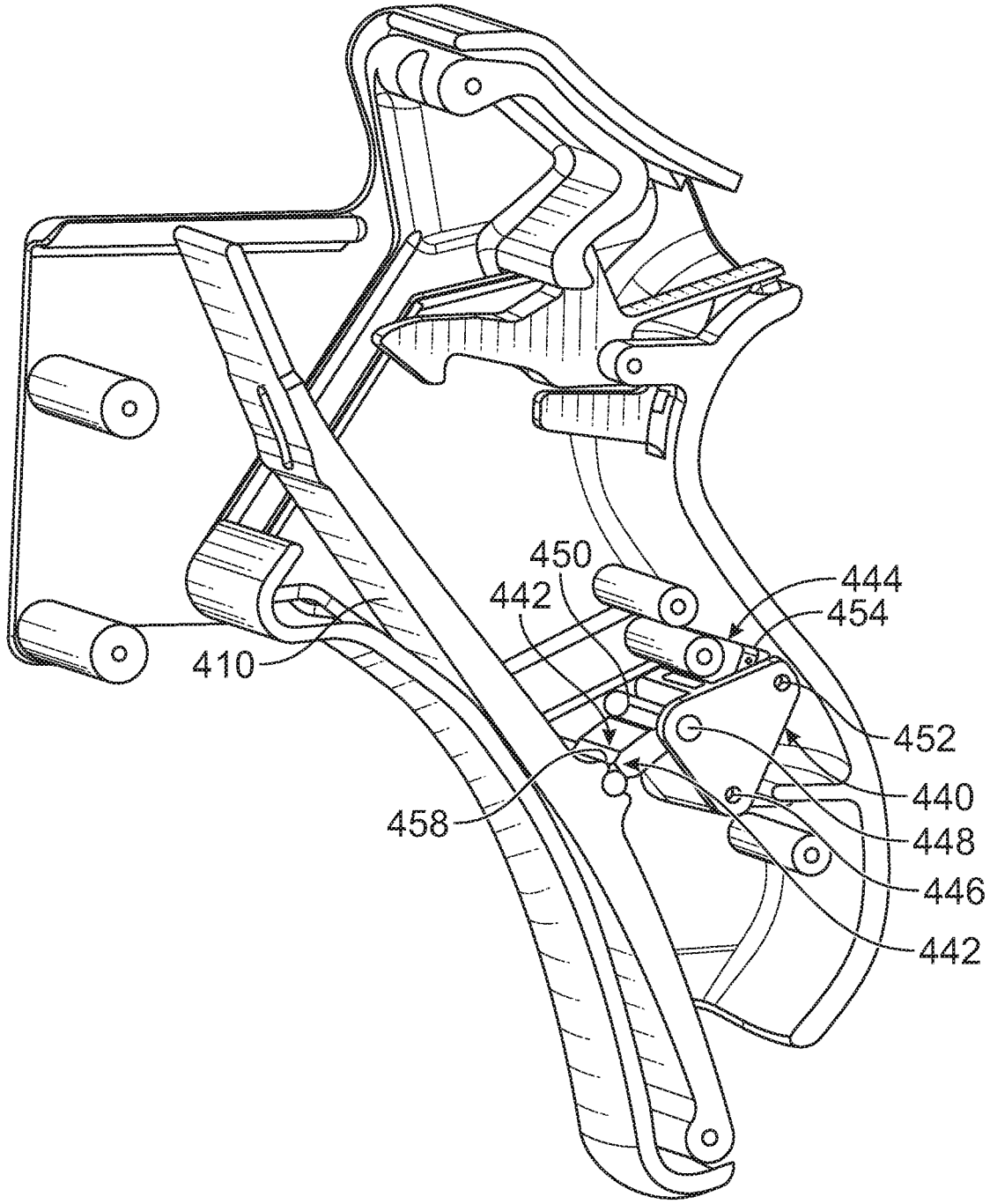
FIG. 27 is a diagrammatic isometric view of the bell crank shown in FIG. 26, showing the launch spring configuration after launch of a projectile.

When the operator brings the trigger housing 404 rearward toward the grip housing 402, the bell-crank assembly 412, FIG. 25, causes the middle section 436 of the launch spring 410 to extend outward or forward in a curve or bow-like configuration. The bell-crank assembly 412 includes three components, a triangular-shaped center part 440, FIGS. 25-27, a spring link 442 and a trigger link 444. (It should be noted that FIGS. 25 and 26 are diagrammatic to show the movement of the bell crank while the remainder of the figures are based on an earlier version of the launch apparatus.) The center part 440 may have three pivot locations, a first pivot 446 for connecting the center part 440 to the grip housing 402 and around which the center part 440 rotates, a second pivot location 448 which pivotally connects the center part 440 to a first end 450 of the spring link 442, and a third pivot location 452 which connects the center part 440 to a first end 454 of the trigger link 444. A second end 456 of the trigger link 444 is rotatably connected to the trigger housing 404, and a second end 458 of the spring link 442 is rotatably connected to the launch spring 410 at the joint 434.

As the trigger housing 404 is drawn inward or rearward, the spring link 444 pivots the center part 440 clockwise (in the views of FIGS. 26 and 27) and the spring link 442 bares forward on the launch spring 410 at the joint 434 to progressively stress the launch spring. The bell crank 412 allows the travel distance of the trigger housing to translate to a priming of the launch spring by being bowed sufficiently to generate the necessary energy to launch the ball. The launch spring 410 is illustrated at rest in FIG. 26, in a fully primed configuration in FIG. 25, and after a projectile has been launched in FIG. 27.

Figure 29:
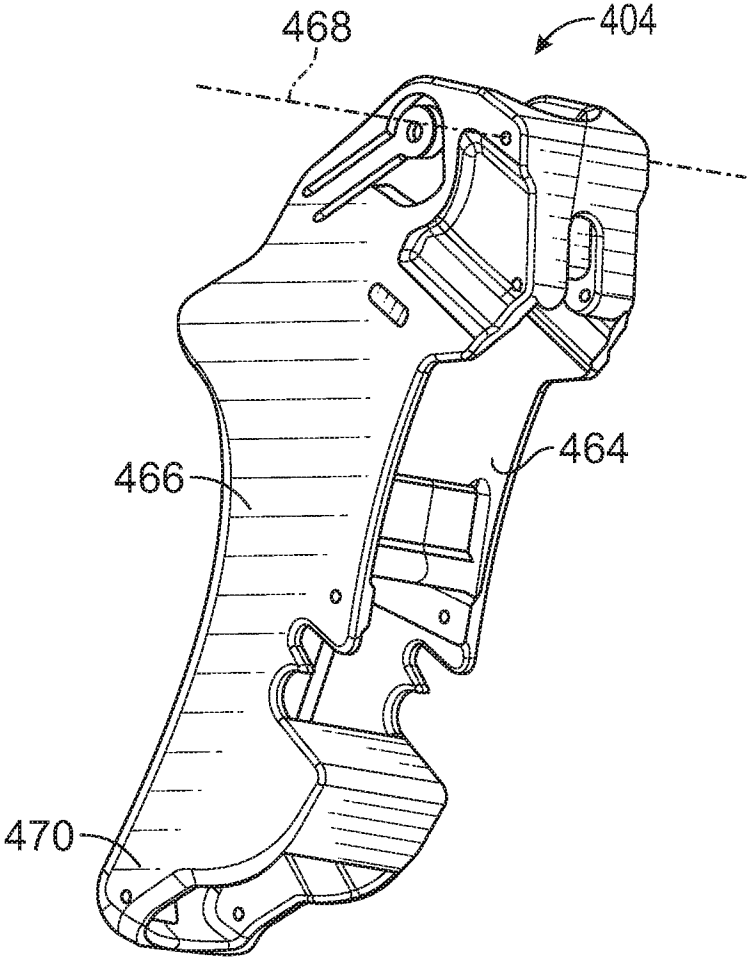
FIG. 29 is an isometric view of a trigger housing of the launch apparatus illustrated in FIGS. 21 and 22, also showing various pivot axes for some of the internal components.
Figure 28:
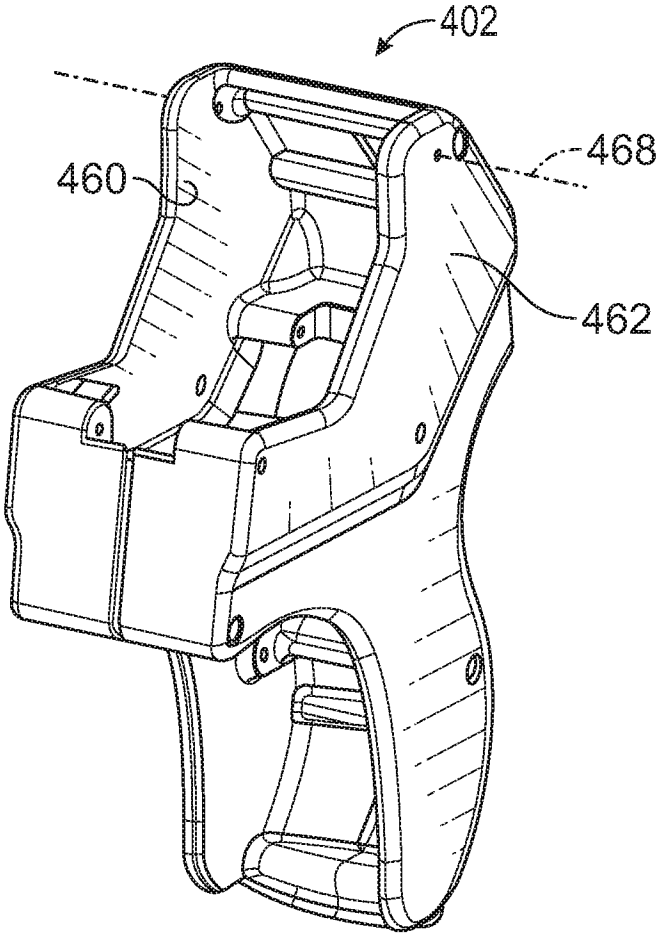
FIG. 28 is an isometric view of a grip housing of the launch apparatus illustrated in FIGS. 21 and 22, showing various pivot axes for some of the internal components.
Figure 30:
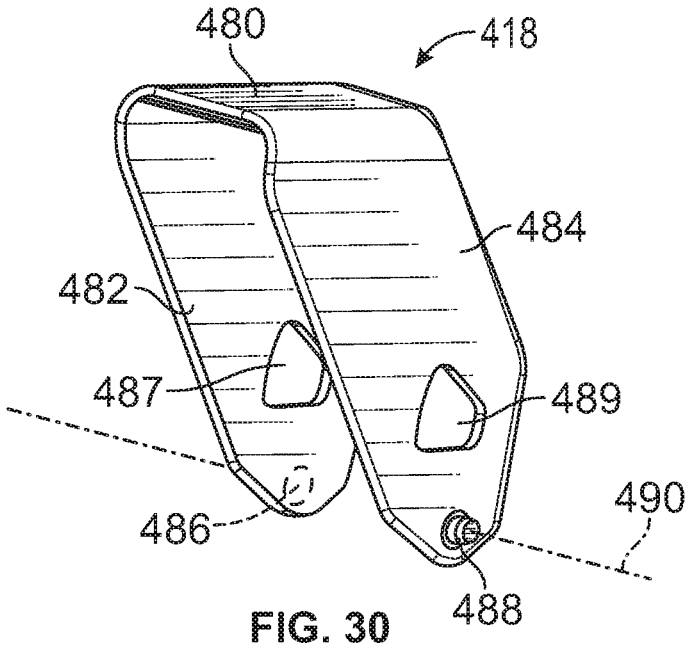
FIG. 30 is an isometric view of the front of a projectile loading port closure of the launch apparatus illustrated in FIGS. 21 and 22.
Figure 31:
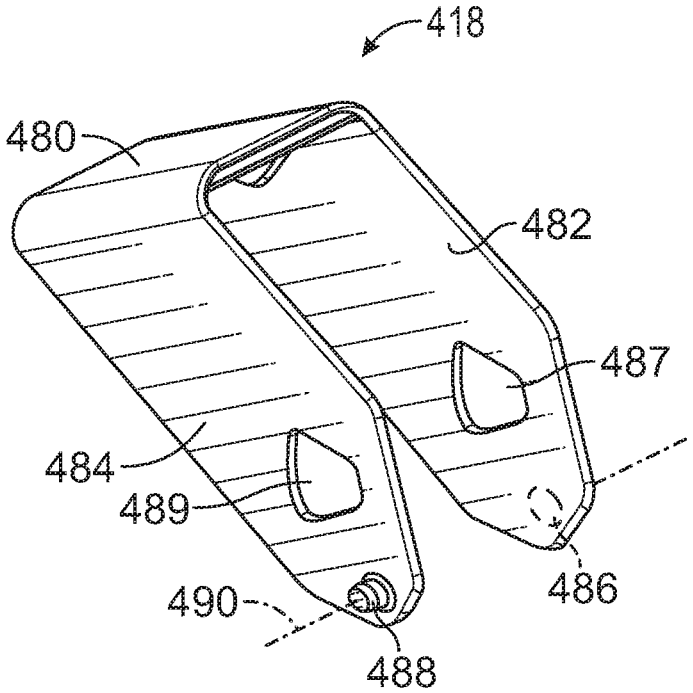
FIG. 31 is an isometric view of the rear of the port closure illustrated in FIG. 30.
Figure 32:
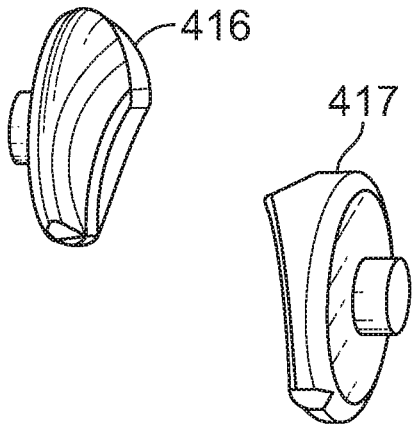
FIG. 32 is an isometric view of a pair of projectile retainers of the launch apparatus illustrated in FIGS. 21 and 22.

The trigger housing 404, FIGS. 28 and 29, and the grip housing 402 may each be molded in two halves, the grip housing having a right half 460 and a left half 462, and the trigger housing having a right half 464 and a left half 466. The housings 402, 404 may have their halves attached by any suitable fastener, such as with screws, snap-fit connectors or an adhesive. The trigger housing 404 is pivotally mounted to the grip housing 402 at a pivot axis 468 allowing a lower portion 470 of the trigger housing 404 to swing through an arc when the operator primes the launch apparatus and causes other parts of the launch apparatus to move in predetermined manners. For example, the port closure 418, FIGS. 22, 30 and 31, is generally U-shaped with a base portion 480, two leg portions 482, 484 and opposing shafts 486, 488, which form a pivot axis 490. The port closure is rotatably mounted to the grip housing 402 and is actuated by lugs protruding from the trigger housing 404 into apertures 487, 489 in the port closure 418, and located in a lowered forward position before priming so that the launch apparatus may be loaded with a ball. When the trigger housing is pulled rearward, the port closure 418 is rotated rearward such that the base portion 480 closes the port 408, FIG. 21, as a safety measure to prevent the operator from inadvertently placing a finger into the port when the spring is storing energy, and to prevent jamming should the user attempt to push a second ball through the port during priming.

Figure 33:
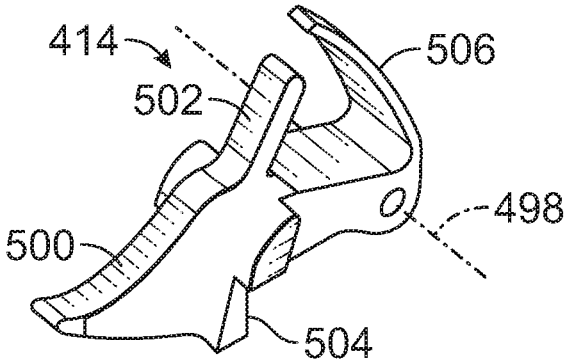
FIG. 33 is an isometric view of the front of a projectile sensor of the launch apparatus illustrated in FIGS. 21 and 22.
Figure 34:
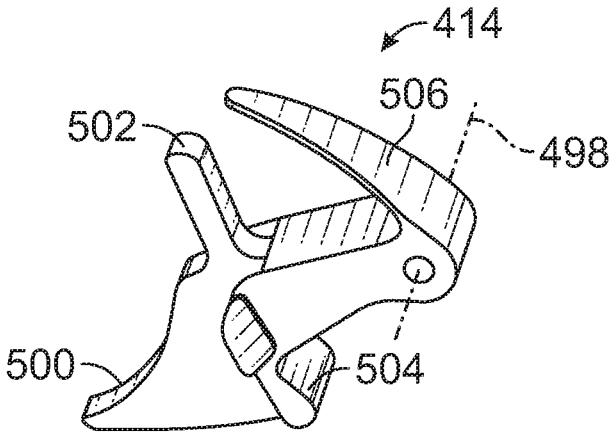
FIG. 34 is an isometric view of the projectile sensor illustrated in FIG. 33.

When the operator loads a ball 409 by pushing the ball through the port 408 in the top of the barrel, two events occur. The ball retainers 416, 417, FIG. 32, which may be spring loaded and slightly dished. The ball retainers have a slight cup shape off-center to bias the ball rearward and downward to position the ball for the launch spring 410. At the same time, the ball also engages the ball sensor 414. The ball sensor 414, FIGS. 22, 33 and 34, is pivotally mounted to the grip housing 402 at a pivot axis 498 and includes four portions, a ball engagement surface 500 which causes the ball sensor to rotate, an upstanding arm 502 to limit upward movement of the ball sensor, a trigger hook engagement surface 504 to lift the trigger hook 420, and a return spring 506 to reset the ball sensor after a ball is launched. With a loaded ball, as the priming proceeds, the surface 504 gradually disengages the hook from the launch spring.

Figure 35:
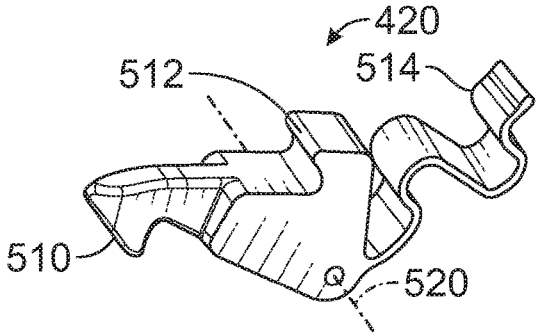
FIG. 35 is an isometric view of the front of a trigger hook of the launch apparatus illustrated in FIGS. 21 and 22.
Figure 36:
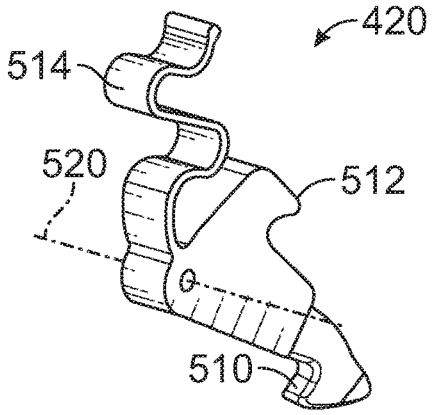
FIG. 36 is an isometric view of the rear of the trigger hook illustrated in FIG. 35.

Beneath the ball sensor 414 is the trigger hook 420, FIGS. 22, 35 and 36, which is pivotally connected to the grip housing 402. The trigger hook 420 includes three portions, a hook 510 that engages and holds the launch spring 410 during priming and until the trigger housing 404 is fully retracted by the operator, an engagement surface 512 that contacts the engagement surface 504 of the ball sensor 414 to cause the hook 510 to be disengaged from the launch spring 410 when the ball sensor 414 is rotated sufficiently, and a return spring 514 to return the trigger hook 420 to the slot 438 when the trigger housing is released by the operator. The trigger hook 420 rotates about a pivot axis 520.

Figure 37:
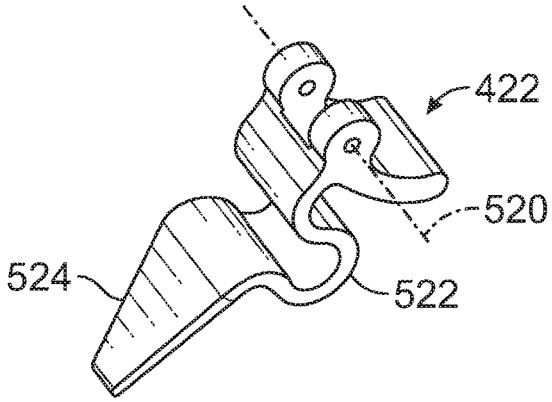
FIG. 37 is an isometric view of the front of a trigger housing return spring of the launch apparatus illustrated in FIGS. 21 and 22.
Figure 38:
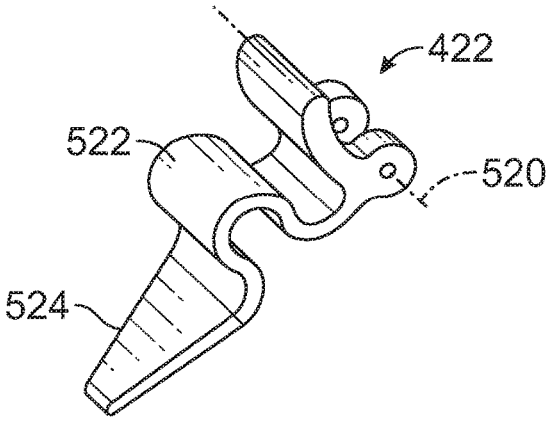
FIG. 38 is an isometric view of the rear of the trigger housing return spring illustrated in FIG. 37.

Beneath the trigger hook 420 is a trigger housing return spring 422, FIGS. 22, 37 and 38. The trigger housing return spring 422 is used to bias the trigger housing 404 to its forward position when the operator releases the trigger housing. The return spring 422 is pivotally mounted about the same pivot axis 520 as the trigger hook 420, and includes an "S" curve 522 and tail 524 that bend when the trigger housing is moved rearward during priming of the launch apparatus and launch of a projectile.

In the alternative, the ball retainers 416, 417, the ball sensor 414, the trigger hook 420 and the trigger housing return spring 422 may be shaped differently and positioned differently without altering their functions, if desired. For example, the ball retainers may be small protrusions without being spring loaded, the ball sensor spring may be extended to replace the movement limiting arm, the shapes of the ball sensor return spring and the trigger housing return spring may take on other suitable shapes without deviating from the invention.

Figure 39:
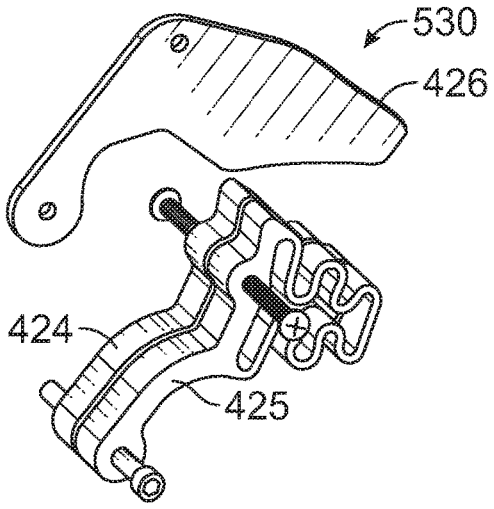
FIG. 39 is an isometric view of the front of a bumper and divider of the launch apparatus illustrated in FIGS. 21 and 22.
Figure 40:
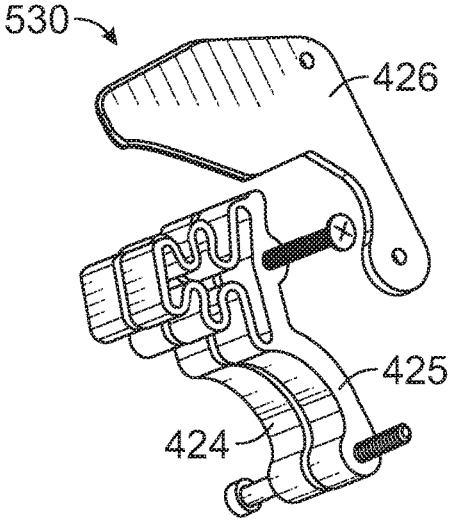
FIG. 40 is an isometric view of the rear of the bumper and divider illustrated in FIG. 39.

After the launch spring 410 is released to launch the ball 409, the still fast moving upper portion 432 of the launch spring 410 engages a bumper assembly 530, FIGS. 39 and 40, including two launch spring stops or bumpers 424, 425, FIGS. 22, 39 and 40, separated by an divider 426. The bumpers 424, 425 cushion the launch spring, and the divider 426 keeps the projectiles from being forced between the spring 410 and the trigger housing 404. The bumpers 424, 425 are each curved or convoluted to provide a springiness to dissipate the energy of the moving launch spring.

It is now noted that the launch apparatus 400 has a number of advantages. The launch apparatus 400 is relatively simple in construction and yet robust and compact. The trigger housing movement is limited and yet a sufficient priming force may be generated. Additionally, while the launch spring is relatively short, the desired launching force is generated.

Operation of the launch apparatus 400 is easy and simple. The operator merely loads a ball through the port and grips the grip and trigger housings in one hand. The operator then aims and squeezes his/her hand around the housings to launch a projectile.

It should now be understood that dimensions of the components may be changed, and so may component configurations to result in different stresses being generated in the launch spring to handle different size launch apparatus or different size and configured projectile.

It is noted that throughout this detailed description words such as "forward," "rearward," "beneath," "upward," downward," "horizontal," "vertical," "upper," "lower," "back," "front," "rear," "top" and "bottom," as well as other similar positional terms, refer to components or elements of the launcher as they are viewed in the attached drawings, or in relationship to the positions of the apparatus as it will typically be deployed and moved during use by an operator, or to movements of elements based on the configurations illustrated.

Figure 41:
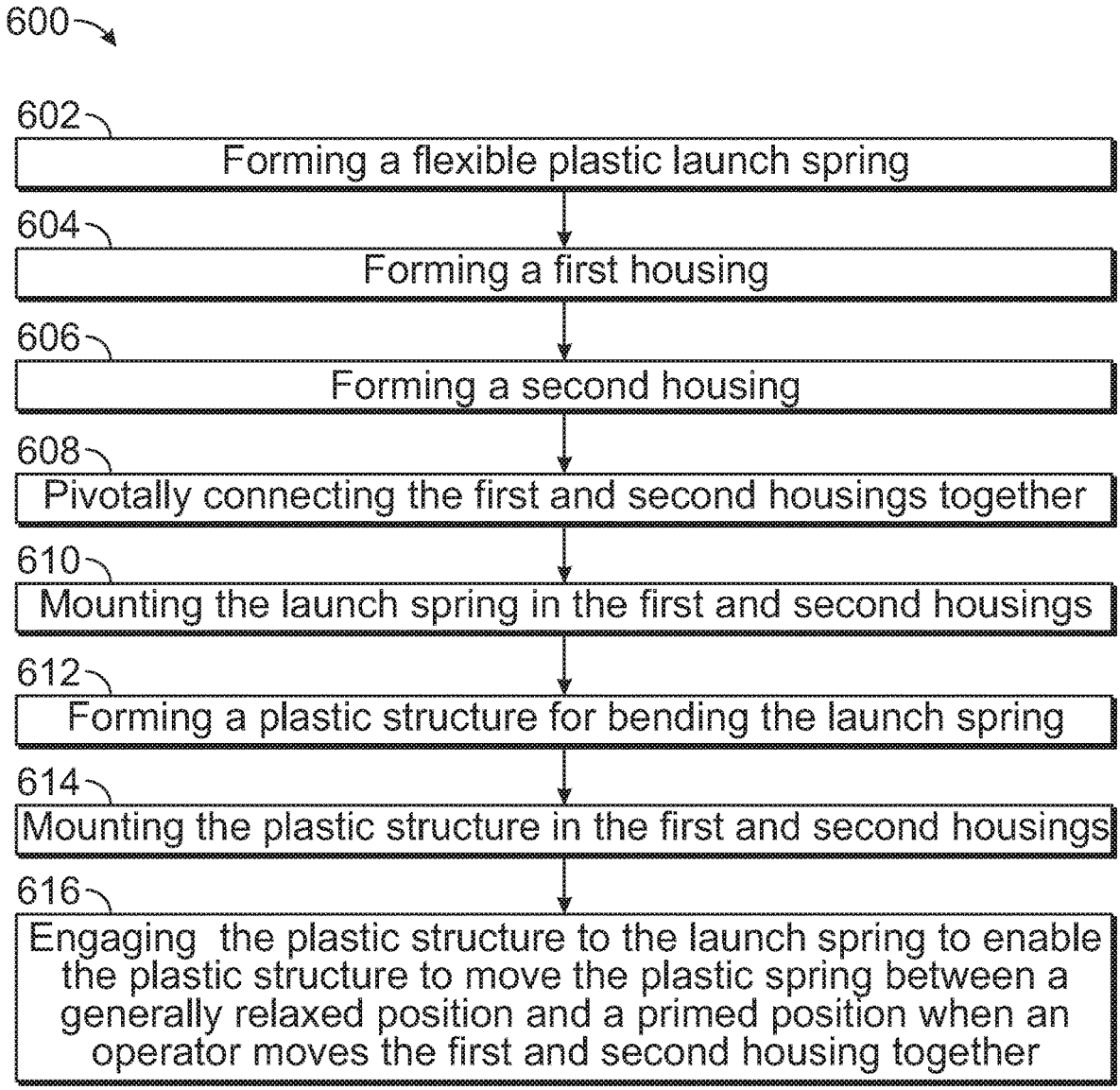
FIG. 41 is flow diagram of a method of making an inventive toy launcher apparatus of the present invention.

The present invention also includes a method 600, FIG. 41, of forming and assembling an inexpensive and relatively simple toy projectile launch apparatus, including the steps of forming a flexible plastic launch spring 602, forming a first housing 604, forming a second housing 606, pivotally connecting the first and second housings together 608, mounting the launch spring in the first and second housings 610, forming a plastic structure for bending the launch spring 612, mounting the plastic structure in the first and second housings 614, and engaging the plastic structure to the launch spring to enable the plastic structure to move the plastic spring between a generally relaxed position and a primed position when an operator moves the first and second housings together.

It may now be appreciated that the toy apparatus disclosed in detail above has great entertainment value, is fun to use and easy to operate. The toy apparatus is compact, lightweight and yet robust, and has a relatively simple structure that may be produced at a substantial cost savings.

From the foregoing, it can be seen that there has been provided a detailed description and features for an improved toy apparatus as well as a disclosure of a method for assembling the toy apparatus. While particular embodiments of the present invention has been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy projectile launch apparatus comprising:

a hand held first housing;

a hand held second housing pivotally connected to the first housing to enable an operator to move the housings toward one another using one hand;

a flexible plastic launch spring having upper and lower portions mounted within the housings, the upper portion of the launch spring for engaging and launching a projectile;

a mechanism mounted within the housings for causing the launch spring to bend when the first and second housings are brought toward one another by the operator; and a restraint mounted to one of the housings for restraining the upper portion of the launch spring until the launch spring is fully bent.

2. The launch apparatus of claim 1 wherein:

the lower portion of the launch spring is restrained by one of the housings.

3. The launch apparatus of claim 2 wherein:

the lower portion of the launch spring is pivotally connected to one of the housings.

4. The launch apparatus of claim 2 wherein:

the launch spring includes a connector about thirty five percent along the length of the launch spring measured from the lower portion.

5. The launch apparatus of claim 2 wherein:

the mechanism is a bell crank.

6. The launch apparatus of claim 2 wherein:

the apparatus is barrel loaded.

7. The launch apparatus of claim 2 wherein:

the apparatus is port loaded.

8. The launch apparatus of claim 2 wherein:

the first housing is adapted to be held in a palm of an operator;

the second housing is operated by fingers of an operator; and the first housing rotates relative to the second housing.

9. The launch apparatus of claim 2 wherein:

the first housing is adapted to be held in a palm of an operator;

the second housing is operated by fingers of an operator; and the second housing rotates relative to the first housing.

10. The launch apparatus of claim 1 wherein:

the launch spring includes a connector about thirty five percent along the length of the launch spring measured from the lower portion.

11. The launch apparatus of claim 10 wherein:

the launch spring is generally shaped as a strip.

12. A toy projectile launch apparatus comprising:

a first housing for gripping by a palm of an operator;

a second housing pivotally connected to the first housing to enable an operator to rotate one housing relative to the other housing;

a strip shaped flexible plastic launch spring having upper and lower portions mounted within the housings, the upper portion for engaging and launching a projectile;

a structure mounted within the housings for causing the launch spring to progressively bend when the operator rotates one housing relative to the other housing; and a restraint mounted to one of the housings for restraining the upper portion of the launch spring until the launch spring is primed.

13. The launch apparatus of claim 12 wherein:

the lower portion of the launch spring is restrained.

14. The launch apparatus of claim 13 wherein:

the structure to progressively bend the launch spring is pivotally connected to the launch spring at about thirty five percent of the length of the launch spring measured from the lower portion of the launch spring.

15. The launch apparatus of claim 14 wherein:

one of the housings includes a port through which a projectile is loaded.

16. The launch apparatus of claim 14 including:

a barrel into which a projectile is loaded.

17. A method of forming and assembling an inexpensive toy projectile launcher comprising the steps of:

forming a flexible plastic launch spring;

forming a first housing;

forming a second housing;

pivotally connecting the first and second housings together;

mounting the launch spring in the first and second housings;

forming a plastic structure for bending the launch spring;

mounting the plastic structure in the first and second housings; and engaging the plastic structure to the launch spring to enable the plastic structure to move the plastic spring between a generally relaxed position and a primed position when an operator moves the first and second housings together.

18. The method of claim 17 including the step of:

restraining a lower end portion of the launch spring in the first and second housings.

19. The method of claim 18 including the step of:

mounting the plastic structure to the launch spring at about thirty-five percent of the length of the launch spring measured from the lower portion.

20. The method of claim 19 including the step of:

rotatably mounting the lower portion of the launch spring to one of the housings.

* * * * *